US006168329B1

(12) United States Patent
Hayama

(10) Patent No.: US 6,168,329 B1
(45) **Date of Patent: *Jan. 2, 2001**

(54) COLOR PRINTING APPARATUS

(75) Inventor: Hitoshi Hayama, Nagano (JP)

(73) Assignee: Seiko Epson Corporation, Tokyo (JP)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/001,281

(22) Filed: Dec. 31, 1997

(30) Foreign Application Priority Data

Jan. 9, 1997 (JP) ..... 9-013395
Nov. 25, 1997 (JP) ..... 9-339361

(51) Int. Cl.[7] ..... B41J 19/30
(52) U.S. Cl. ..... 400/323; 400/120.02; 400/615.2
(58) Field of Search ..... 400/615.2, 586, 400/320, 319, 323, 120.02

(56) References Cited

U.S. PATENT DOCUMENTS 5,044,796 * 9/1991 Lund ..... 400/323
5,373,368 * 12/1994 Taniguro ..... 358/296
5,619,233 * 4/1997 Harrington ..... 347/37
5,890,820 * 4/1999 Handa ..... 400/615.2

FOREIGN PATENT DOCUMENTS 62-279957 12/1987 (JP) .
63-280671 11/1988 (JP) .
596806 4/1993 (JP) .
7108682 4/1995 (JP) .

* cited by examiner

*Primary Examiner*—John S. Hilten
(74) *Attorney, Agent, or Firm*—Hogan & Hartson, LLP

(57) ABSTRACT

A color printing apparatus is provided for realizing highly attractive print images and high speed color printing with a relatively simple position control. The color printing apparatus comprises a printer unit for printing a color print image composed of a dot matrix on a printing medium, a feeder unit for feeding the printing medium, a reciprocal moving mechanism for reciprocally moving the printer unit in directions orthogonal to a direction in which the printing medium is fed, and a controller for instructing the printer unit to perform printing in a plurality of colors to each dot of the color print image so as to selectively conduct uni-directional printing and/or bi-directional printing in the reciprocal movements of the printer unit. The controller instructs the printer unit to conduct the uni-directional printing for a high contrast color with respect to a background color of the printing medium within the plurality of colors, and to conduct the bi-directional printing for the remaining colors.

11 Claims, 22 Drawing Sheets

FIG. 9

| No | P+k | D | EQUATION OF R | j \ i | 0 | 1 | 2 | 3 | ⋯ | PATTERN |
|---|---|---|---|---|---|---|---|---|---|---|
| 1-1 | 1 | 1 | j+i | 0 | 0 | 1 | 2 | 3 | ⋯ | A |
| | | | | 1 | 1 | 2 | 3 | 4 | ⋯ | |
| | | | | 2 | 2 | 3 | 4 | 5 | ⋯ | |
| | | | | 3 | 3 | 4 | 5 | 6 | ⋯ | |
| | | | | ⋮ | ⋮ | ⋮ | ⋮ | ⋮ | | |
| 1-2 | | 2 | j+2i | 0 | 0 | 2 | 4 | 6 | ⋯ | |
| | | | | 1 | 1 | 3 | 5 | 7 | ⋯ | |
| | | | | 2 | 2 | 4 | 6 | 8 | ⋯ | |
| | | | | 3 | 3 | 5 | 7 | 9 | ⋯ | |
| | | | | ⋮ | ⋮ | ⋮ | ⋮ | ⋮ | | |
| 1-x | | x | j+xi | — | ALL AVAILABLE | | | | | |
| 2-1 | 2 | 1 | 2j+i | 0 | 0 | 1 | 2 | 3 | ⋯ | B |
| | | | | 1 | 2 | 3 | 4 | 5 | ⋯ | |
| | | | | 2 | 4 | 5 | 6 | 7 | ⋯ | |
| | | | | 3 | 8 | 9 | 10 | 11 | ⋯ | |
| | | | | ⋮ | ⋮ | ⋮ | ⋮ | ⋮ | | |
| 2-2 | | 2 | 2j+2i | × | ONLY 2'S MULTIPLES AVAILABLE | | | | | NG |
| 2-3 | | 3 | 2j+3i | 0 | 0 | 3 | 6 | 9 | ⋯ | C |
| | | | | 1 | 2 | 5 | 8 | 11 | ⋯ | |
| | | | | 2 | 4 | 7 | 10 | 13 | ⋯ | |
| | | | | 3 | 6 | 9 | 12 | 15 | ⋯ | |
| | | | | ⋮ | ⋮ | ⋮ | ⋮ | ⋮ | | |
| 2-4 | | 4 | 2j+4i | × | ONLY 2'S MULTIPLES AVAILABLE | | | | | NG |
| 2-5 | | 5 | 2j+5i | 0 | 0 | 5 | 10 | 15 | ⋯ | D |
| | | | | 1 | 2 | 7 | 12 | 17 | ⋯ | |
| | | | | 2 | 4 | 9 | 14 | 19 | ⋯ | |
| | | | | 3 | 6 | 11 | 16 | 21 | ⋯ | |
| | | | | 4 | 8 | 13 | 18 | 23 | ⋯ | |
| | | | | 5 | 10 | 15 | 20 | 25 | ⋯ | |
| | | | | 6 | 12 | 17 | 22 | 27 | ⋯ | |
| | | | | ⋮ | ⋮ | ⋮ | ⋮ | ⋮ | | |
| 2-6 | | 6 | 2j+6i | × | ONLY 2'S MULTIPLES AVAILABLE | | | | | NG |
| 2-7 | | 7 | 2j+7i | 0 | 0 | 7 | 14 | | ⋯ | — |
| | | | | 1 | 2 | 9 | 16 | | ⋯ | |

FIG. 10A

〔A〕

| Step \ Pass | 1 | 2 | 3 |
|---|---|---|---|
| t=0 | ① | | |
| 1 | ② | ① | |
| 2 | | ② | ① |
| 3 | | | ② |
| 4 | | | |
| 5 | | | |

FIG. 10B

〔B〕

| Step \ Pass | 1 | 2 | 3 |
|---|---|---|---|
| t=0 | ① | | |
| 1 | ② | | |
| 2 | ③ | ① | |
| 3 | | ② | |
| 4 | | ③ | ① |
| 5 | | | ② |
| | | | ③ |

FIG. 10C

〔C〕

OK

| Step \ Pass | 1 | 2 | 3 | 4 |
|---|---|---|---|---|
| t=0 | ① | | | |
| 1 | | | | |
| 2 | | ① | | |
| 3 | ② | | | |
| 4 | | | ① | |
| 5 | | ② | | |
| 6 | ③ | | | ① |
| 7 | | | ② | |
| 8 | | ③ | | |
| 9 | | | | ② |
| 10 | | | ③ | |
| 11 | | | | |
| 12 | | | | ③ |
| 13 | | | | |
| 14 | | | | |

FIG. 10D

〔D〕

OK

| Step \ Pass | 1 | 2 | 3 | 4 | 5 |
|---|---|---|---|---|---|
| t=0 | ① | | | | |
| 1 | | | | | |
| 2 | | ① | | | |
| 3 | | | | | |
| 4 | | | ① | | |
| 5 | ② | | | | |
| 6 | | | | ① | |
| 7 | | ② | | | |
| 8 | | | | | ① |
| 9 | | | ② | | |
| 10 | ③ | | | | |
| 11 | | | | ② | |
| 12 | | ③ | | | |
| 13 | | | | | ② |
| 14 | | | ③ | | |

FIG. 11

| No | P+k | D | EQUATION OF R | j \ i | 0 | 1 | 2 | 3 | ··· | PATTERN |
|---|---|---|---|---|---|---|---|---|---|---|
| 3-1 | 3 | 1 | 3j+i | 0 | 0 | 1 | 2 | 3 | ··· | E |
| | | | | 1 | 3 | 4 | 5 | 6 | ··· | |
| | | | | 2 | 6 | 7 | 8 | 9 | ··· | |
| | | | | 3 | 9 | 10 | 11 | 12 | ··· | |
| | | | | ⋮ | ⋮ | ⋮ | ⋮ | ⋮ | | |
| 3-2 | | 2 | 3j+2i | 0 | 0 | 2 | 4 | 6 | ··· | F |
| | | | | 1 | 3 | 5 | 7 | 9 | ··· | |
| | | | | 2 | 6 | 8 | 10 | 12 | ··· | |
| | | | | 3 | 9 | 11 | 13 | 15 | ··· | |
| | | | | ⋮ | ⋮ | ⋮ | ⋮ | ⋮ | | |
| 3-3 | | 3 | 3j+3i | × | ONLY 3'S MULTIPLES AVAILABLE | | | | | NG |
| 3-4 | | 4 | 3j+4i | 0 | 0 | 4 | 8 | 12 | ··· | G |
| | | | | 1 | 3 | 7 | 11 | 15 | ··· | |
| | | | | 2 | 6 | 10 | 14 | 18 | ··· | |
| | | | | 3 | 9 | 13 | 17 | 21 | ··· | |
| | | | | 4 | 12 | 16 | 20 | 24 | ··· | |
| | | | | 5 | 15 | 19 | 23 | 27 | ··· | |
| | | | | ⋮ | ⋮ | ⋮ | ⋮ | ⋮ | | |
| 3-5 | | 5 | 3j+5i | 0 | 0 | 5 | 10 | 15 | ··· | H |
| | | | | 1 | 3 | 8 | 13 | 18 | ··· | |
| | | | | 2 | 6 | 11 | 16 | 21 | ··· | |
| | | | | 3 | 9 | 14 | 19 | 24 | ··· | |
| | | | | 4 | 12 | 17 | 22 | 27 | ··· | |
| | | | | 5 | 15 | 20 | 25 | 30 | ··· | |
| | | | | ⋮ | ⋮ | ⋮ | ⋮ | ⋮ | | |
| 3-6 | | 6 | 3j+6i | × | ONLY 3'S MULTIPLES AVAILABLE | | | | | NG |

FIG. 12A

〔E〕

| Step \ Pass | 1 | 2 | 3 | 4 |
|---|---|---|---|---|
| t=0 | ① | | | |
| 1 | ② | | | |
| 2 | ③ | | | |
| 3 | ④ | ① | | |
| 4 | | ② | | |
| 5 | | ③ | | |
| 6 | | ④ | ① | |
| 7 | | | ② | |
| 8 | | | ③ | |
| 9 | | | ④ | ① |
| 10 | | | | ② |
| 11 | | | | ③ |
| 12 | | | | ④ |

FIG. 12B

〔F〕

OK

| Step \ Pass | 1 | 2 | 3 | 4 |
|---|---|---|---|---|
| t=0 | ① | | | |
| 1 | | | | |
| 2 | ② | | | |
| 3 | | ① | | |
| 4 | ③ | | | |
| 5 | | ② | | |
| 6 | ④ | | ① | |
| 7 | | ③ | | |
| 8 | | | ② | |
| 9 | | ④ | | ① |
| 10 | | | ③ | |
| 11 | | | | ② |
| 12 | | | ④ | |
| | | | | ③ |

FIG. 12C

〔G〕

OK

| Step \ Pass | 1 | 2 | 3 | 4 |
|---|---|---|---|---|
| t=0 | ① | | | |
| 1 | | | | |
| 2 | | | | |
| 3 | | ① | | |
| 4 | ② | | | |
| 5 | | | | |
| 6 | | | ① | |
| 7 | | ② | | |
| 8 | ③ | | | |
| 9 | | | | ① |
| 10 | | | ② | |
| 11 | | ③ | | |
| 12 | ④ | | | |
| 13 | | | | ② |
| 14 | | | ③ | |
| | | ④ | | |

FIG. 12D

〔H〕

OK

| Step \ Pass | 1 | 2 | 3 | 4 | 5 |
|---|---|---|---|---|---|
| t=0 | ① | | | | |
| 1 | | | | | |
| 2 | | | | | |
| 3 | | ① | | | |
| 4 | | | | | |
| 5 | ② | | | | |
| 6 | | | ① | | |
| 7 | | | | | |
| 8 | | ② | | | |
| 9 | | | | ① | |
| 10 | ③ | | | | |
| 11 | | | ② | | |
| 12 | | | | | ① |
| 13 | | ③ | | | |
| 14 | | | | ② | |
| | ④ | | | | |

FIG. 13

| j \ i | 0 | 1 | 2 | 3 | 4 | 5 | 6 | 7 | 8 | 9 | 10 |
|---|---|---|---|---|---|---|---|---|---|---|---|
| 0 | 0 | 3 | 6 | 9 | 12 | 15 | 18 | 21 | 24 | 27 | 30 |
| 1 | 4 | 7 | 10 | 13 | 16 | 19 | 22 | 25 | 28 | 31 | 34 |
| 2 | 8 | 11 | 14 | 17 | 20 | 23 | 26 | 29 | 32 | 35 | 38 |
| 3 | 12 | 15 | 18 | 21 | 24 | 27 | 30 | 33 | 36 | 39 | 42 |
| 4 | 16 | 19 | 22 | 25 | 28 | 31 | 34 | 37 | 40 | 43 | 46 |
| 5 | 20 | 23 | 26 | 29 | 32 | 35 | 38 | 41 | 44 | 47 | 50 |
| 6 | 24 | 27 | 30 | 33 | 36 | 39 | 42 | 45 | 48 | 51 | 54 |
| 7 | 28 | 31 | 34 | 37 | 40 | 43 | 46 | 49 | 52 | 55 | 58 |
| 8 | 32 | 35 | 38 | 41 | 44 | 47 | 50 | 53 | 56 | 59 | 62 |
| 9 | 36 | 39 | 42 | 45 | 48 | 51 | 54 | 57 | 60 | 63 | 66 |
| 10 | 40 | 43 | 46 | 49 | 52 | 55 | 58 | 61 | 64 | 67 | 70 |

FIG. 14A

| j \ i | 0 | 1 | 2 | 3 |
|---|---|---|---|---|
| 0 | 0 | 3 | 6 | 9 |
| 1 | 4 | 7 | 10 | 13 |
| 2 | 8 | 11 | 14 | 17 |
| 3 | 12 | 15 | 18 | 21 |
| 4 | 16 | 19 | 22 | 25 |
| 5 | 20 | 23 | 26 | 29 |
| 6 | 24 | 27 | 30 | 33 |

FIG. 14B

| j \ i | 0 | 3 | 6 | 9 |
|---|---|---|---|---|
| 0 | 0 | 9 | 18 | 27 |
| 1 | 4 | 13 | 22 | 31 |
| 2 | 8 | 17 | 26 | 35 |
| 3 | 12 | 21 | 30 | 39 |
| 4 | 16 | 25 | 34 | 43 |
| 5 | 20 | 29 | 38 | 47 |
| 6 | 24 | 33 | 42 | 51 |

FIG. 14C

| j \ i | 0 | 2 | 3 | 5 |
|---|---|---|---|---|
| 0 | 0 | 6 | 9 | 15 |
| 1 | 4 | 10 | 13 | 19 |
| 2 | 8 | 14 | 17 | 23 |
| 3 | 12 | 18 | 21 | 27 |
| 4 | 16 | 22 | 25 | 31 |
| 5 | 20 | 26 | 29 | 35 |
| 6 | 24 | 30 | 33 | 39 |

FIG. 15

〔J〕

| Step \ Pass | 1 | 2 | 3 | 4 |
|---|---|---|---|---|
| t=0 | ① | | | |
| 1 | | | | |
| 2 | | | | |
| 3 | ② | | | |
| 4 | | ① | | |
| 5 | | | | |
| 6 | ③ | | | |
| 7 | | ② | | |
| 8 | | | ① | |
| 9 | ④ | | | |
| 10 | | ③ | | |
| 11 | | | ② | |
| 12 | | | | ① |
| 13 | | ④ | | |
| 14 | | | ③ | |
| | | | | ② |

OK

FIG. 16

〔K〕

| Step \ Pass | 1 | 2 | 3 | 4 | 5 | 6 | 7 | 8 |
|---|---|---|---|---|---|---|---|---|
| t=0 | ① | | | | | | | |
| 1 | | | | | | | | |
| 2 | | | | | | | | |
| 3 | | | | | | | | |
| 4 | | ① | | | | | | |
| 5 | | | | | | | | |
| 6 | | | | | | | | |
| 7 | | | | | | | | |
| 8 | | | ① | | | | | |
| 9 | ② | | | | | | | |
| 10 | | | | | | | | |
| 11 | | | | | | | | |
| 12 | | | | ① | | | | |
| 13 | | ② | | | | | | |
| 14 | | | | | | | | |
| 15 | | | | | | | | |
| 16 | | | | | ① | | | |
| 17 | | | ② | | | | | |
| 18 | ③ | | | | | | | |
| 19 | | | | | | | | |
| 20 | | | | | | ① | | |
| 21 | | | | ② | | | | |
| 22 | | ③ | | | | | | |
| 23 | | | | | | | | |
| 24 | | | | | | | ① | |
| 25 | | | | | ② | | | |
| 26 | | | ③ | | | | | |
| 27 | ④ | | | | | | | |
| 28 | | | | | | | | ① |
| 29 | | | | | | ② | | |
| 30 | | | | ③ | | | | |
| 31 | | ④ | | | | | | |

OK

FIG. 17

〔L〕

| Step \ Pass | 1 | 2 | 3 | 4 | 5 | 6 | 7 | 8 |
|---|---|---|---|---|---|---|---|---|
| t=0 | ① | | | | | | | |
| 1 | | | | | | | | |
| 2 | | | | | | | | |
| 3 | | | | | | | | |
| 4 | | ① | | | | | | |
| 5 | | | | | | | | |
| 6 | ② | | | | | | | |
| 7 | | | | | | | | |
| 8 | | | ① | | | | | |
| 9 | ③ | | | | | | | |
| 10 | | ② | | | | | | |
| 11 | | | | | | | | |
| 12 | | | | ① | | | | |
| 13 | | ③ | | | | | | |
| 14 | | | ② | | | | | |
| 15 | ④ | | | | | | | |
| 16 | | | | | ① | | | |
| 17 | | | ③ | | | | | |
| 18 | | | | ② | | | | |
| 19 | | ④ | | | | | | |
| 20 | | | | | | ① | | |
| 21 | | | | ③ | | | | |
| 22 | | | | | ② | | | |
| 23 | | | ④ | | | | | |
| 24 | | | | | | | ① | |
| 25 | | | | | ③ | | | |
| 26 | | | | | | ② | | |
| 27 | | | | ④ | | | | |
| 28 | | | | | | | | ① |
| 29 | | | | | | ③ | | |
| 30 | | | | | | | ② | |
| 31 | | | | | ④ | | | |

OK

FIG. 18

| j \ i | 0 | 1 | 2 | 3 | 4 | 5 | 6 | 7 |
|---|---|---|---|---|---|---|---|---|
| 0 | 0 | 3 | 6 | 9 | 12 | 15 | 18 | 21 |
| 2 | 8 | 11 | 14 | 17 | 20 | 23 | 26 | 29 |
| 4 | 16 | 19 | 22 | 25 | 28 | 31 | 34 | 37 |
| 6 | 24 | 27 | 30 | 33 | 36 | 39 | 42 | 45 |

FIG. 19A

〔M〕

| Step \ Pass | 1 | 2 | 3 |
|---|---|---|---|
| t=0 | ① | | |
| 1 | | | |
| 2 | | | |
| 3 | ② | | |
| 4 | | | |
| 5 | | | |
| 6 | ③ | | |
| 7 | | | |
| 8 | | ① | |
| 9 | ④ | | |
| 10 | | | |
| 11 | | ② | |
| 12 | ⑤ | | |
| 13 | | | |
| 14 | | ③ | |
| 15 | ⑥ | | |
| 16 | | | ① |
| 17 | | ④ | |
| 18 | ⑦ | | |
| 19 | | | ② |
| 20 | | ⑤ | |
| 21 | ⑧ | | |
| 22 | | | ③ |
| 23 | | ⑥ | |
| 24 | | | |
| | | | ④ |

OK

FIG. 19B

〔N〕

| Step \ Pass | 1 | | 2 | | 3 | |
|---|---|---|---|---|---|---|
| | 1-0 | 1-1 | 2-0 | 2-1 | 3-0 | 3-1 |
| t=0 | ① | | | | | |
| 1 | | | | | | |
| 2 | | | | | | |
| 3 | ② | | | | | |
| 4 | | ① | | | | |
| 5 | | | | | | |
| 6 | ③ | | | | | |
| 7 | | ② | | | | |
| 8 | | | ① | | | |
| 9 | ④ | | | | | |
| 10 | | ③ | | | | |
| 11 | | | ② | | | |
| 12 | | | | ① | | |
| 13 | | ④ | | | | |
| 14 | | | ③ | | | |
| 15 | | | | ② | | |
| 16 | | | | | ① | |
| 17 | | | ④ | | | |
| 18 | | | | ③ | | |
| 19 | | | | | ② | |
| 20 | | | | | | ① |
| 21 | | | | ④ | | |
| 22 | | | | | ③ | |
| 23 | | | | | | ② |
| 24 | | | | | | |
| | | | | | ④ | |

FIG. 20A

| j \ i | 0 | 1 | 2 | 3 | 4 | 5 | 6 | 7 | 8 | 9 | 10 |
|---|---|---|---|---|---|---|---|---|---|---|---|
| 0-0 | 0 | 4 | 8 | 12 | 16 | 20 | 24 | 28 | 32 | 36 | 40 |
| 0-2 | 2 | 6 | 10 | 14 | 18 | 22 | 26 | 30 | 34 | 38 | 42 |
| 1-0 | 5 | 9 | 13 | 17 | 21 | 25 | 29 | 33 | 37 | 41 | 45 |
| 1-2 | 7 | 11 | 15 | 19 | 23 | 27 | 31 | 35 | 39 | 43 | 47 |
| 2-0 | 10 | 14 | 18 | 22 | 26 | 30 | 34 | 38 | 42 | 46 | 50 |
| 2-1 | 12 | 16 | 20 | 24 | 28 | 32 | 36 | 40 | 44 | 48 | 52 |
| 3-0 | 15 | 19 | 23 | 27 | 31 | 35 | 39 | 43 | 47 | 51 | 55 |
| 3-2 | 17 | 21 | 25 | 29 | 33 | 37 | 41 | 45 | 49 | 53 | 57 |
| 4-0 | 20 | 24 | 28 | 32 | 36 | 40 | 44 | 48 | 52 | 56 | 60 |
| 4-2 | 22 | 26 | 30 | 34 | 38 | 42 | 46 | 50 | 54 | 58 | 62 |
| 5-0 | 25 | 29 | 33 | 37 | 41 | 45 | 49 | 53 | 57 | 61 | 65 |
| 5-2 | 27 | 31 | 35 | 39 | 43 | 47 | 51 | 55 | 59 | 63 | 67 |

FIG. 20B

| j \ i | 0 | 1 | 2 | 3 | 4 | 5 | 6 | 7 | 8 | 9 | 10 |
|---|---|---|---|---|---|---|---|---|---|---|---|
| 0-0 | 0 | 4 | 8 | 12 | 16 | 20 | 24 | 28 | 32 | 36 | 40 |
| 0-3 | 3 | 7 | 11 | 15 | 19 | 23 | 27 | 31 | 35 | 39 | 43 |
| 1-0 | 5 | 9 | 13 | 17 | 21 | 25 | 29 | 33 | 37 | 41 | 45 |
| 1-3 | 8 | 12 | 16 | 20 | 24 | 28 | 32 | 36 | 40 | 44 | 48 |
| 2-0 | 10 | 14 | 18 | 22 | 26 | 30 | 34 | 38 | 42 | 46 | 50 |
| 2-3 | 13 | 17 | 21 | 25 | 29 | 33 | 37 | 41 | 45 | 49 | 53 |
| 3-0 | 15 | 19 | 23 | 27 | 31 | 35 | 39 | 43 | 47 | 51 | 55 |
| 3-3 | 18 | 22 | 26 | 30 | 34 | 38 | 42 | 46 | 50 | 54 | 58 |
| 4-0 | 20 | 24 | 28 | 32 | 36 | 40 | 44 | 48 | 52 | 56 | 60 |
| 4-3 | 23 | 27 | 31 | 35 | 39 | 43 | 47 | 51 | 55 | 59 | 63 |
| 5-0 | 25 | 29 | 33 | 37 | 41 | 45 | 49 | 53 | 57 | 61 | 65 |
| 5-3 | 28 | 32 | 36 | 40 | 44 | 48 | 52 | 56 | 60 | 64 | 68 |

FIG. 21A

〔O〕

| Step \ Pass | 1 | 2 | 3 | 4 | 5 |
|---|---|---|---|---|---|
| t=0 | ① | | | | |
| 1 | | | | | |
| 2 | | | | | |
| 3 | | | | | |
| 4 | ② | | | | |
| 5 | | ① | | | |
| 6 | | | | | |
| 7 | | | | | |
| 8 | ③ | | | | |
| 9 | | ② | | | |
| 10 | | | ① | | |
| 11 | | | | | |
| 12 | ④ | | | | |
| 13 | | ③ | | | |
| 14 | | | ② | | |
| 15 | | | | ① | |
| 16 | ⑤ | | | | |
| 17 | | ④ | | | |
| 18 | | | ③ | | |
| 19 | | | | ② | |
| 20 | ⑥ | | | | ① |
| 21 | | ⑤ | | | |
| 22 | | | ④ | | |
| 23 | | | | ③ | |
| 24 | | | | | ② |
| 25 | | ⑥ | | | |

OK

FIG. 21B

〔P〕

| Step \ Pass | 1 | 2 | 3 | 4 | 5 |
|---|---|---|---|---|---|
| t=0 | ① | | | | |
| 1 | | | | | |
| 2 | [1] | | | | |
| 3 | | | | | |
| 4 | ② | | | | |
| 5 | | ① | | | |
| 6 | [2] | | | | |
| 7 | | [1] | | | |
| 8 | ③ | | | | |
| 9 | | ② | | | |
| 10 | | | ① | | |
| 11 | | [2] | | | |
| 12 | ④ | | [1] | | |
| 13 | | ③ | | | |
| 14 | | | ② | | |
| 15 | | | | ① | |
| 16 | ⑤ | | [2] | | |
| 17 | | ④ | | [1] | |
| 18 | | | ③ | | |
| 19 | | | | ② | |
| 20 | | | | | ① |
| 21 | | ⑤ | | [2] | |
| 22 | | | ④ | | [1] |
| 23 | | | | ③ | |
| 24 | | | | | ② |
| 25 | | | | | |

OK

FIG. 22A

〔O〕

| Step \ Pass | 1 | 2 | 3 | 4 | 5 |
|---|---|---|---|---|---|
| t=0 | ① | | | | |
| 1 | | | | | |
| 2 | | | | | |
| 3 | | | | | |
| 4 | ② | | | | |
| 5 | | ① | | | |
| 6 | | | | | |
| 7 | | | | | |
| 8 | ③ | | | | |
| 9 | | ② | | | |
| 10 | | | ① | | |
| 11 | | | | | |
| 12 | ④ | | | | |
| 13 | | ③ | | | |
| 14 | | | ② | | |
| 15 | | | | ① | |
| 16 | ⑤ | | | | |
| 17 | | ④ | | | |
| 18 | | | ③ | | |
| 19 | | | | ② | |
| 20 | ⑥ | | | | ① |
| 21 | | ⑤ | | | |
| 22 | | | ④ | | |
| 23 | | | | ③ | |
| 24 | | | | | ② |
| 25 | | ⑥ | | | |

OK

FIG. 22B

〔Q〕

| Step \ Pass | 1 | 2 | 3 | 4 | 5 |
|---|---|---|---|---|---|
| t=0 | ① | | | | |
| 1 | | | | | |
| 2 | | | | | |
| 3 | | | | | |
| 4 | ② | | | | |
| 5 | | ① | | | |
| 6 | | | | | |
| 7 | 2 | | | | |
| 8 | ③ | | | | |
| 9 | | ② | | | |
| 10 | | | ① | | |
| 11 | 3 | | | | |
| 12 | ④ | 2 | | | |
| 13 | | ③ | | | |
| 14 | | | ② | | |
| 15 | | | | ① | |
| 16 | ⑤ | 3 | | | |
| 17 | | ④ | 2 | | |
| 18 | | | ③ | | |
| 19 | | | | ② | |
| 20 | | | | | ① |
| 21 | | ⑤ | 3 | | |
| 22 | | | ④ | 2 | |
| 23 | | | | ③ | |
| 24 | | | | | ② |
| 25 | | | | | |

OK

COLOR PRINTING APPARATUS

BACKGROUND OF THE INVENTION

1. Field of the Invention

The present invention relates generally to a color printing apparatus, and more particularly to a color printing apparatus for printing a color print image composed of a dot matrix.

2. Description of the Related Art

In a color printing apparatus of the type mentioned above, a plurality of primary colors, for example, yellow, cyan, and magenta are superimposed on each dot in a color print image to realize a desired color for each dot, thus providing for a variety of color print images. Moreover, it has been a general tendency to add black to the three colors to print images using four primary colors in order to realize more attractive color print images in additional consideration of brightness or the like, and also in order to print particularly solid black portions in images.

On the other hand, for achieving required improvements in printing speed and print quality (print resolution and so on), there have been widely used color printing apparatus which perform printing in two directions, i.e., a going direction and a returning direction of reciprocal movements of a printing head in directions orthogonal to a feeding direction of a printing medium.

In the bi-directional printing, however, when a vertical straight line L is to be printed on a printing medium T, for example, as illustrated in FIG. 1B, i.e., in the same direction as a feeding direction of the printing medium T (a PF direction indicated in FIG. 1A), mechanical variations or the like of stopping positions of a printing head at left and right limits (CR direction) and stepping feed of the printing medium T cause the straight line L to be jaggy. Particularly, in an image which has a high contrast color with respect to a background color of the printing medium T, the contour of the image appears clearly due to the high contrast, so that displaced dots, if any, printed on the printing medium T become more prominent.

It should be noted herein that while the term "contrast" may refer only to the degree of difference in brightness (bright and shade) or luminance in a particular technical field, the term "contrast" in this disclosure is used to have its essential meaning, i.e., the meaning of "comparison (for demonstrating a difference), or the difference indicated thereby." Thus, the term "contrast" in the following description includes not only the meaning of a difference in brightness or the like but also the meaning of a difference in color (hue and saturation, see FIG. 2), reflectivity, lustre (brightness), contrast, and so on, and refers to the degree of such difference, particularly to the degree of visual difference (identity). For example, the "contrast" represents a concept which generally includes visually contrastable differences such as a black image on a white printing medium T, cyan with red, a low saturation color with a high saturation color, a low lustrous image with a highly lustrous image, and so on. Moreover, it is assumed that a high contrast color includes not only a distinctive contrast colors (such as red with respect to cyan) but also a color which provides a visually prominent contour to some degree in comparison with other colors in a printed image, such as colors having a similar tendency (for example, a color prevalently including a hue such as blue, green and so on with respect to red).

For printing a character image (or a sequence of characters) such as a letter, a symbol, a figure, or the like on a predetermined background image, while the background image may be rough to some degree as long as a general impression is understandable, the character image must be clearly identifiable, so that any deviations of dots printed as a character image are more prominent. Moreover, a high contrast color is often used for distinctly printing a character image in contrast with a background image, in which case deviated dots, if any, become further prominent.

It will be understood from the foregoing that the bi-directional printing requires a high accuracy in its position control in a variety of cases as mentioned above in comparison with a uni-directional printing (see Laid-open Japanese Patent Application Nos. 62-279957, 63-280671, and so on). More specifically, the bi-directional printing requires a complicated position control for absorbing a deviation due to variations in moving conditions depending on a moving direction, in addition to a zero point correction at the left and right limits of a print available region.

OBJECTS AND SUMMARY OF THE INVENTION

In view of the problems mentioned above, it is an object of the present invention to provide a color printing apparatus which is capable of solving the problems of the prior art as mentioned above, and specifically, which is capable of realizing an attractive color print at a high printing speed with a relatively simple position control.

To solve the above object, according to a first aspect of the present invention, there is provided a color printing apparatus comprising printing means for printing a color print image composed of a dot matrix on a printing medium, feeding means for feeding the printing medium, reciprocal moving means for reciprocally moving the printing means in directions orthogonal to a direction in which the printing medium is fed, and control means for instructing the printing means to perform printing in a plurality of colors to each dot of the color print image so as to selectively conduct uni-directional printing and/or bi-directional printing in the reciprocal movements of the printing means, wherein the control means instructs the printing means to conduct the uni-directional printing for a high contrast color with respect to a background color of the printing medium within the plurality of colors, and to conduct the bi-directional printing for the remaining colors.

The color printing apparatus prints a high contrast color with respect to the color of a printing medium in one of two directions orthogonal to a direction in which the printing medium is fed, so that moving conditions for the printing means in a printing operation can be made identical for all dots to be printed. Stated another way, since positional deviations due to a difference in moving direction or the like in the bi-directional printing can be prevented, horizontal deviations are less likely to occur even when a straight line or the like is drawn. Also, since the printing in other colors is controlled by a bi-directional printing scheme similar to the prior art, it is possible to meet requirements to printing speed, printing quality, and so on. In addition, since these colors have a relatively low contrast, deviations are less prominent even if occurring in an image. The color printing apparatus therefore provides for high speed printing and highly attractive print images with a relatively simple position control similar to that used in a uni-directional printing scheme.

Preferably, in the color printing apparatus, the print image includes a character image and a background image, and the control means instructs the printing means to print the high contrast color for the character image and to print one of the remaining colors for the background image.

In the color printing apparatus, a print image may have a character image and a background image, wherein the character image is printed using a high contrast color, while the background image is printed using one of the remaining colors, so that the character image can be clearly and distinctively printed on the background image. Also, since the character image is printed in accordance with a uni-directional printing control, it is possible to prevent positional deviations due to a difference in moving direction or the like in the bi-directional printing.

According to a second aspect of the present invention, there is provided a color printing apparatus comprising printing means for printing a color print image composed of a dot matrix on a printing medium, feeding means for feeding the printing medium, reciprocal moving means for reciprocally moving the printing means in a direction orthogonal to a direction in which the printing medium is fed, and control means for instructing the printing means to perform printing in a plurality of colors to each dot of the color print image so as to selectively conduct uni-directional printing and/or bi-directional printing in the reciprocal movements of the printing means, wherein the color print image includes a character image and a background image, and the control means instructs the printing means to conduct the uni-directional printing for the character image and the bi-directional printing for the background image.

In the color printing apparatus mentioned above, while a print image may have a character image and a background image, the character image, in which deviations of printed dots are more prominent, is printed in one of two directions orthogonal to a direction in which the printing medium is fed, so that it is possible to prevent positional deviations due to a difference in moving direction or the like in the bi-directional printing. On the other hand, the background image, which may be relatively rough, is printed under the bi-directional printing control similar to the prior art, thereby making it possible to meet the requirements to the printing speed, the printing quality, and so on. The color printing apparatus therefore provides for high speed printing and highly attractive print images with a relatively simple position control similar to that used in a uni-directional printing scheme.

Preferably, in the color printing apparatus mentioned above, the control means instructs the printing means to print the character image using a high contrast color relative to the background image within the plurality of colors.

Since the color printing apparatus prints a character image using a high contrast color relative to a background image, the character image can be clearly and distinctively printed with respect to the background image. Also, since the character image is printed under the uni-directional printing control, it is possible to prevent positional deviations due to a difference in moving direction or the like in the bi-directional printing.

Preferably, in one reciprocal movement of the printing means in the color printing apparatus, the number of printable dots provided by the uni-directional printing is equal to or larger than the number of printable dots provided by the bi-directional printing.

In this color printing apparatus, since the number of printable dots in the uni-directional printing is equal to or larger than the number of printable dots in the bi-directional printing, it is possible even for the uni-directional printing to maintain the printing speed, the printing quality and so on comparable to those generally available in the bi-directional printing, so that highly attractive color images can be provided with a relatively simple position control similar to that used in a uni-directional printing scheme.

In the above-mentioned color printing apparatus, the printing medium is preferably a tape-like printing medium.

Since the color printing apparatus employs a tape-like printing medium, the color printing apparatus may be applied, for example, to a color printer for printing on a tape for creating labels or the like, while maintaining the advantages mentioned above. Particularly when an image or the like is printed on a tape-like printing medium, it is often the case that respective character strings aligned in the longitudinal direction (feeding direction or PF direction) are printed in a plurality of rows in the width direction (reciprocally moving directions orthogonal to the feeding direction or CR direction). In such a situation, since the above-mentioned positional deviations or the like in the horizontal direction appear as distorted character strings, the deviations become more prominent. Thus, the above-mentioned advantage of making less prominent the positional deviations in the horizontal direction (width direction) acts more effectively when a printing medium is in the form of a tape.

BRIEF DESCRIPTION OF THE DRAWINGS

FIG. 9 is a table showing the relationship between a tape feeding pitch, a nozzle pitch of a ink jet head, and printable dots which is common to a uni-directional printing control and a bi-directional printing control;

FIGS. 10A–10D illustrate printing controls corresponding to FIG. 9 and patterns of printable dots;

FIG. 11 is a table similar to FIG. 9 when a different tape feeding pitch is employed;

FIGS. 12A–12D are tables similar to FIGS. 10A–10D corresponding to FIG. 11;

FIG. 13 is a table showing the values of printable dots when the tape feeding pitch is different from that of FIGS. 9 and 11;

FIGS. 14A–14C are tables showing a typical example and modified examples of printing control using the table of FIG. 13;

FIGS. 15–17 are tables similar to FIGS. 10A–10D corresponding to FIGS. 14A, 14B and 14C, respectively;

FIG. 18 is a table similar to FIG. 14A used when the tape feeding pitch is changed;

FIGS. 19A and 19B are tables similar to FIG. 10A–10D used when the printing controls of FIG. 14A and FIG. 18 are applied to the printing control processing illustrated in FIG. 8;

FIGS. 20A and 20B are tables similar to FIG. 13 showing other examples;

FIGS. 21A and 21B are tables similar to FIGS. 19A and 19B corresponding to the printing control of FIG. 20A; and FIGS. 22A and 22B are tables similar to FIGS. 19A and 19B corresponding to the printing control of FIG. 20B.

DESCRIPTION OF THE PREFERRED EMBODIMENTS

A color printing apparatus according to the present invention will hereinafter be described in detail in connection with several preferred embodiments thereof with reference to the accompanying drawings.

Figure 3:
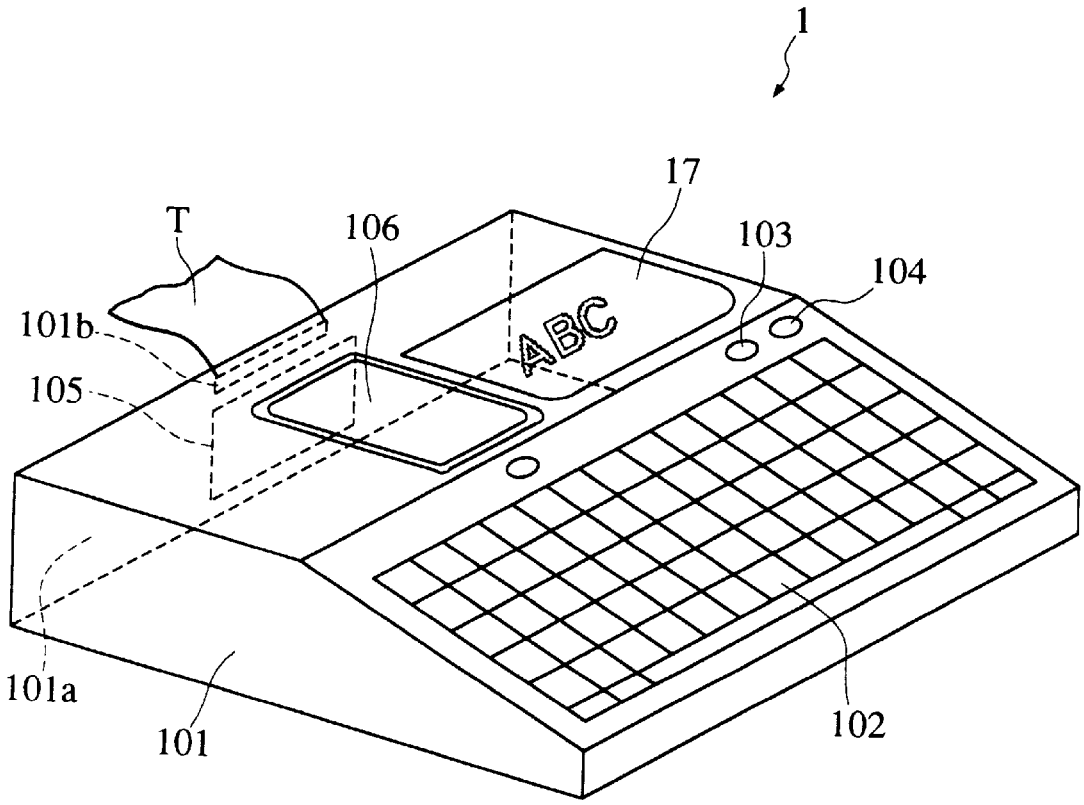
FIG. 3 is a perspective view illustrating an outer appearance of an ink jet printer which embodies the present invention.
Figure 4:
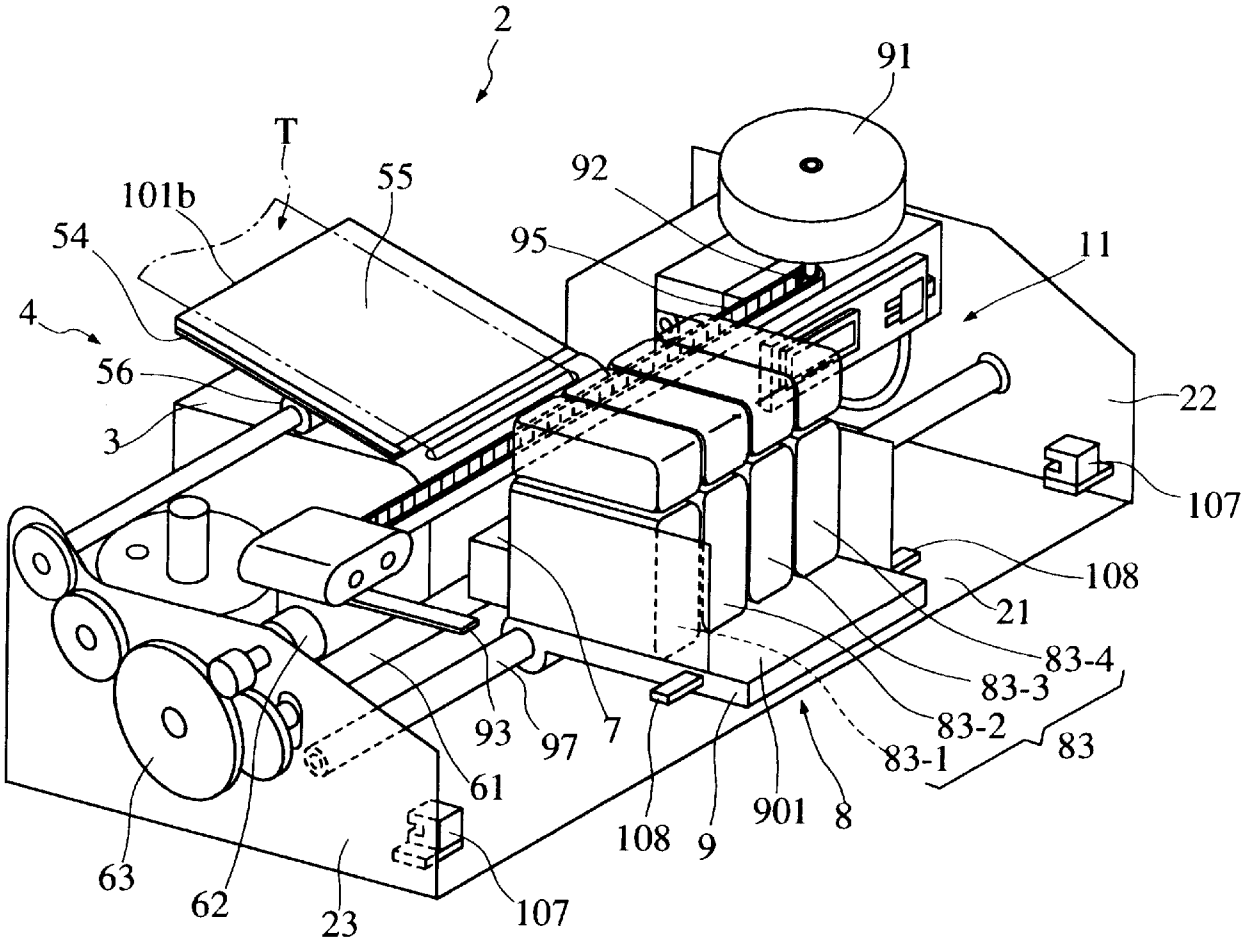
FIG. 4 is a perspective view schematically illustrating a driving mechanism unit for a printer unit incorporated in the ink jet printer of FIG. 3.

FIG. 3 illustrates a perspective view of an outer appearance of an ink jet printer 1 embodying a color printing apparatus according to one embodiment of the present invention, and FIG. 4 illustrates a general perspective view of a printer unit 2 arranged in the ink jet printer 1. The ink jet printer 1 may be sometimes referred to as a label printer, a label word processor, or the like. As illustrated in FIGS. 3 and 4, a tape-like recording medium T for printing, with a separator (hereinafter simply referred to as the "tape"), is accommodated in a tape cartridge 3 in a rolled state. The tape cartridge 3 is mounted on a cartridge carrier 4, and a color image is printed on the tape T fed from the tape cartridge 3 using an ink jet head 7. A variety of tapes T having different tape widths and colors may be provided for particular applications. Such tapes T may be available accommodated in respective appropriate tape cartridges 3.

A specific configuration of the ink jet printer 1 will be described below in greater detail. As illustrated in FIG. 3, the ink jet printer 1 has a generally low-profile rectangular casing 101. A keyboard input unit 102 is provided in a front half portion of the top surface of the casing 101. The keyboard 102 has a variety of keys including a print button 103 for instructing a printing operation, a power supply button 104, and so on.

The keyboard input unit 102 includes color specifying keys 102C and a color setting key 102A (see FIG. 7) for specifying a color when print data is printed, in addition to keys for inputting print data such as character information to be printed. The color specifying keys 102C include a red specifying key for specifying red; a yellow specifying key for specifying yellow; and similarly, a green specifying key, a blue specifying key, a purple specifying key, a black specifying key, and a white specifying key (either of which is not shown).

In a rear portion of the top surface of the casing 101, a liquid crystal display unit 17 is disposed for displaying character information or the like which is input through manipulations on keys on the keyboard input unit 102. On the rear end surface 101*a* of the casing 101, on the other hand, a tape feed-out port 101*b* is formed in a central position near the upper edge of the surface 101*a*, such that the tape T is fed out through the tape feed-out port 101*b* after it is printed. A lid 105 is disposed below the tape feed-out port 101*b* and may be opened for replacing the tape cartridge 3. In addition, in a central portion of the top surface of the casing 101, another lid 106 is disposed for replacing an ink cartridge 8, later described.

The casing 101 contains a power source unit, a battery such as nickel-cadmium battery or the like (not shown), and so on positioned in a front portion beneath the keyboard input unit 102. A printer unit 2 illustrated in FIG. 4 is also contained in the casing 101 in a rear portion.

As illustrated in FIG. 4, the printer unit 2 comprises the cartridge carrier 4 on which a tape cartridge 3, serving as a source of the tape T, is removably mounted; an ink jet head 7 for performing printing on the tape T fed from the cartridge 3 mounted on the cartridge carrier 4; an ink cartridge 8 removably mounted for supplying ink to the ink jet head 7; and a carriage 9 for reciprocally moving the ink jet head 7 in the width direction of the tap T. The carriage 9 is formed with an ink cartridge carrier 901 for removably mounting the ink cartridge 8 thereon. Also, a head cap mechanism 11 is disposed for covering ink nozzles of the ink jet head 7 as well as for performing a cleaning operation or the like for the ink nozzles using a pump motor 111 (see FIG. 7) as required.

Next, the respective constituent units of the printer unit 2 will be described in greater detail. The printer unit 2 comprises a base 21 for mounting its components mentioned above. A carriage motor (hereinafter simply referred to as the "CR motor") 91 is mounted on a motor mounting plate (not shown) extending horizontally from a right-side wall 22 of the base 21. An output shaft of the CR motor 91 extends downward, and a pulley 92 is secured at the lower end of the output shaft. On the left-side wall 23, opposite to the right-side wall 22, a tension pulley (not shown) is rotatably supported at the front end of a tension lever 93 supported on the base 21. A timing belt 95 is laid between these pulleys with a fixed tension force.

Linked to the timing belt 95 is the upper side of the carriage 9 on which the ink jet head 7 is mounted, so that the carriage 9 is moved as the timing belt 95 runs. More specifically, when the timing belt 95 is driven in the forward or backward direction by forward or backward rotation of the CR motor 91, the ink jet head 7 and the ink cartridge 8 mounted on the carriage 9 reciprocally move in the left and right directions, guided by a cartridge guiding shaft 9 extending between the left-side wall 22 and the right-side wall 23. Thus, a desired image can be printed on the surface of the tape T by driving the ink jet head 7 in synchronism with the left and right reciprocal movements, i.e., the reciprocal movements in the width direction of the tape T.

Position detecting sensors 107, each comprising photo-interrupter or the like, are attached on the right-side wall 22 and the left-side wall 23 of the base 21, such that the CR motor 91 stops when a light shielding plate 108 protruding from the cartridge 9 faces the position detecting sensor 107. More specifically, as the moving ink jet head 7 reaches a home position (not shown) on the left (right) side, the associated position sensor 107 detects the ink jet head 7 to bring the ink jet head 7 in a standby state at the home position through the CR motor 91. The home position serves not only as the standby position for the ink jet head 7 but also as a reference position for printing. In other words, a zero point of the CR motor 91 is regularly corrected by the position detecting sensors 107, so that the CR motor 91 is rotated by a predetermined number of steps from the corrected zero point to highly accurately move the ink jet head 7 to appropriate positions in the width direction of the tape T in a print available range.

It should be noted that, according to the present invention, since highly attractive printing can be achieved if an accurate position detection is carried out only on one side, as will be described later, one of the left and right position detecting sensors 107 may be omitted.

Next, the ink cartridge 8 may comprise, for example, four ink tanks 83 (83-1, 83-2, 83-2, 83-4) which store yellow ink, cyan ink, magenta ink, and black ink, respectively. Thus, the ink jet head 7 also has ink nozzles (not shown) corresponding to the respective colors.

Figure 5:
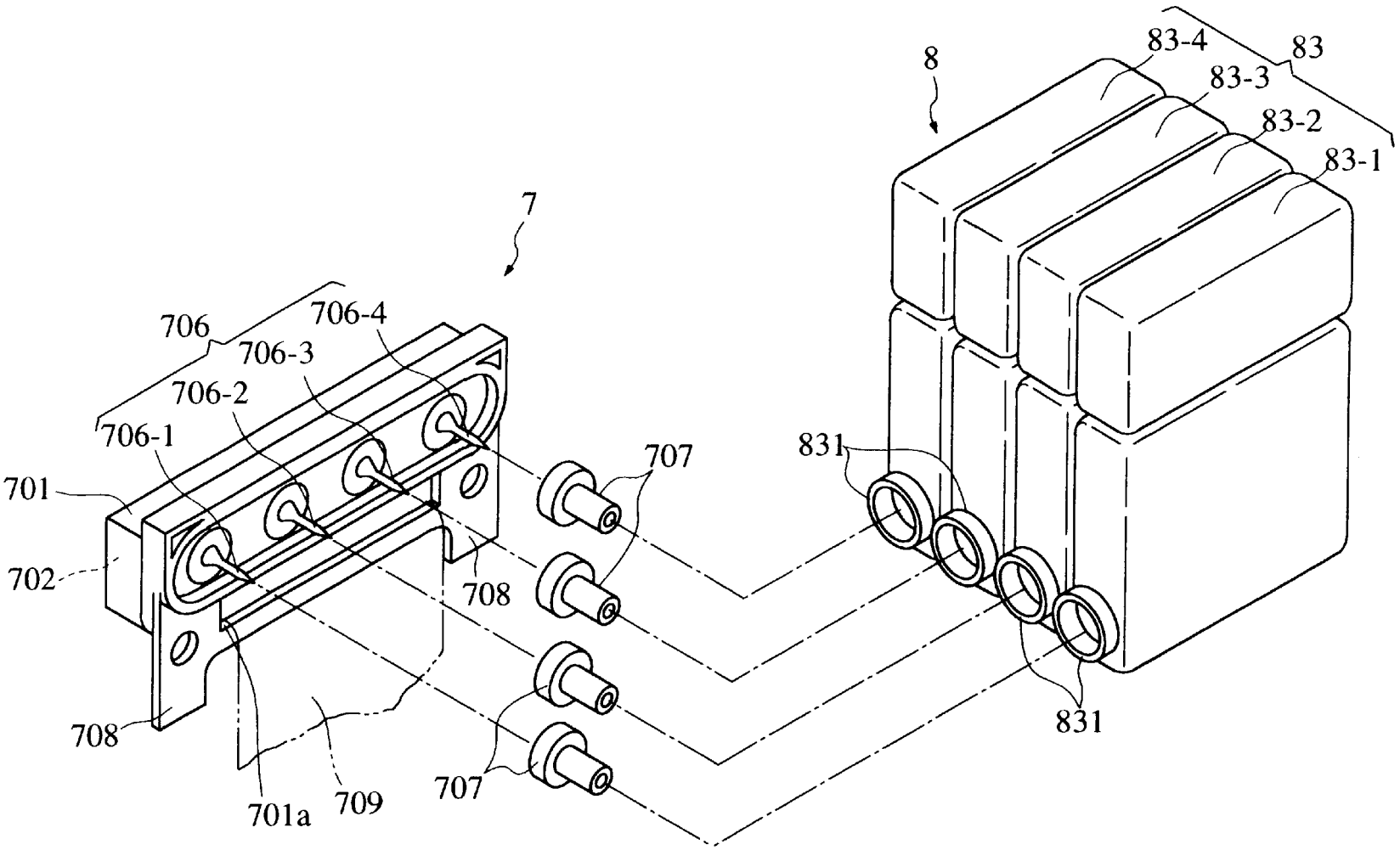
FIG. 5 is a perspective view schematically illustrating an ink jet head equipped in the ink jet printer of FIG. 3 and a removable ink cartridge connected to the ink jet head, wherein the ink jet head and the removable ink cartridge are extracted from the ink jet printer.

As illustrated in FIG. 5, the ink jet head 7 comprises a generally rectangular head case 701 which has a head body 702 formed in a front wall fabricated by semiconductor manufacturing technologies. The head body 702 is formed on the surface thereof with a large number of ink nozzles (not shown) from which ink droplets are discharged. On the rear surface of the head case 701, needle-like protrusions 706 (706-1, 706-2, 706-3, 706-4) protrude corresponding to the ink tanks 83 of the respective colors.

A cylindrical ink filter cartridge 707 is fitted on each needle-like protrusion 706, and ink of each color stored in each ink tank 83 is supplied to the ink jet head 7 through the ink filter cartridge 707 fitted on an ink supply port 831 and the needle-like protrusion 706 within the ink filter cartridge 707.

The head case 701 of the ink jet head 7 is formed on the left and right sides thereof with extensions 708 which are secured to the cartridge 9 with screws or the like. Also, as indicated by imaginary lines, a flexible cable 709 is disposed within the head case 701 through a slit 701*a* open on the rear surface of the head case 701 for wiring, and has one end connected to the main body of the ink jet head 7 on the front side and the other end connected to a driving circuit 281 (see FIG. 7) for the ink jet head 7. The ink jet head 7 is electrically driven through the cable 709 to discharge ink therefrom.

Figure 6B:
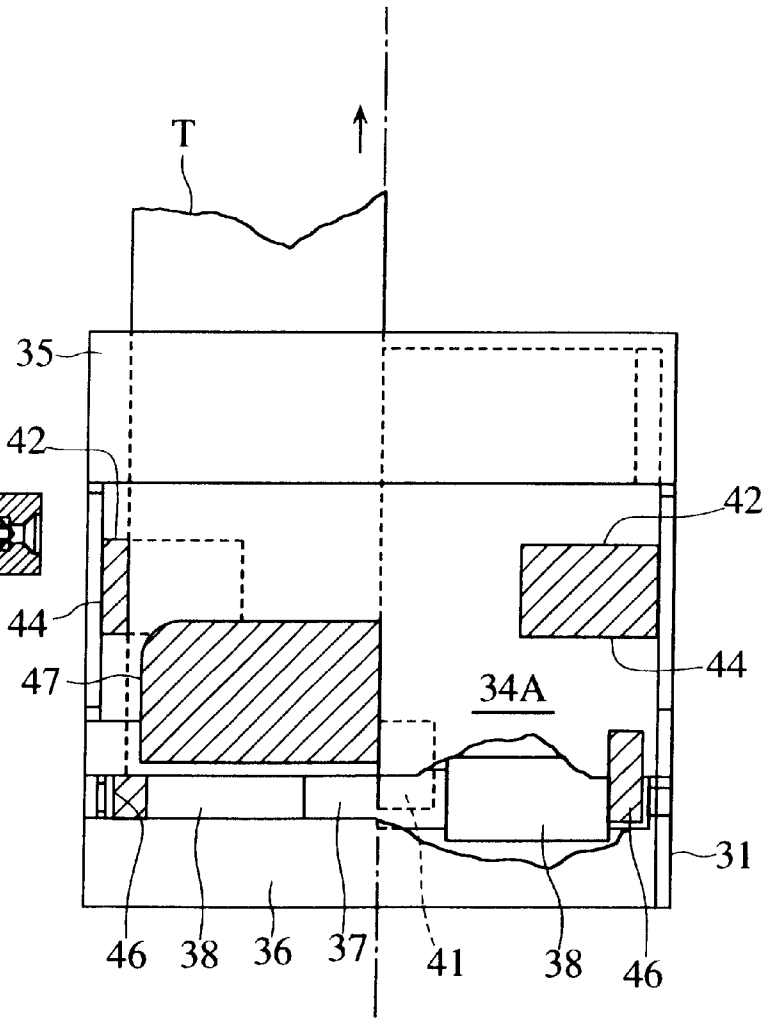
FIG. 6B is an explanatory view for illustrating a front wall of the tape cartridge.
Figure 6A:
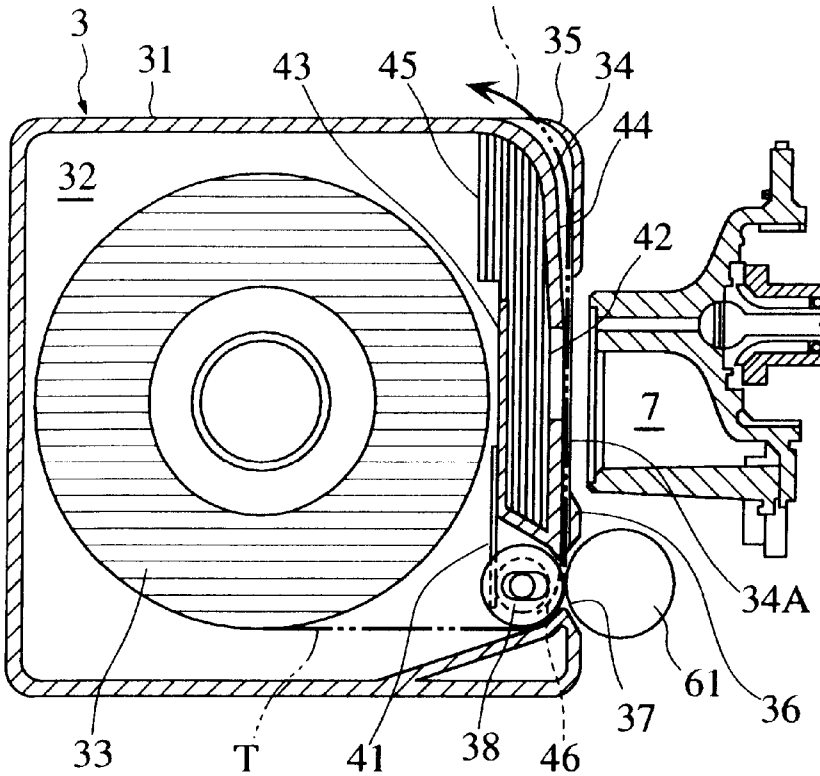
FIG. 6A is a cross-sectional view schematically illustrating a tape cartridge and a mounting portion thereof for the ink jet printer of FIG. 3.

FIG. 6A illustrates a cross-sectional view of the tape cartridge 3, and FIG. 6B illustrates a front wall 34 of the tape cartridge 3. The tape cartridge 3 has a rectangular cartridge case 31 which contains a tape roll 33, on which a tape T is rolled, positioned at the center of an inner space 32 of the tape cartridge 3. A middle height portion of the front wall 34 of the cartridge case 31 is just positioned to face the ink nozzles of the ink jet head 7 when the cartridge case 31 is mounted.

The tape T is fed along the surface of a front wall portion 34A inside of an upper guide wall 35 and a lower guide wall 36 integrally formed with the cartridge case 31. A pair of left and right tape holding rollers 38 are disposed on the inner side of a feed-out port 37 formed through a lower portion of the front wall 34. Each of the tape holding rollers 38 is urged by a leaf spring 41 attached on the inner wall of the cartridge case 31 and is supported by the cartridge case 31 against the spring force. Also, inside the front wall portion 34A of the cartridge case 31, a wasted ink recovery tank 44 is defined by the inner wall 43 of the cartridge case 31 and is filled with an ink absorbing material 45, a portion of which is exposed through a pair of recovery windows 42 to the ink jet head 7.

Moreover, a catch-in preventing guide plate 46 is attached outside the tape holding roller 38 such that the tape T can be always fed out in an appropriate condition. The catch-in preventing guide plate 46 extends downward while closing a space between the upper edge of the feed-out port 37 and the tape holding roller 38. A supplementary guide plate 47 gradually approaching the front wall portion 34A toward an upper end, is also disposed inside a lower guide wall 36 for ensuring that the tape T fed from the tape cartridge 3 is guided to a printing position.

Turning back to FIG. 4, a feeding roller 61 rotatably extends between the left-side wall 22 and the right-side wall 23. A tape feeding mechanism including the feeding roller 61 also comprises a paper feed motor (hereinafter referred to as the "PF motor") 62 mounted to the left-side wall 23 of the driving mechanism unit, and a deceleration gear train 63 for transmitting the power of the PF motor 62 to the feeding roller 61. Gears forming the deceleration gear train 63 are rotatably supported by the outer surface of the left-side wall 23.

The tape T is sent upwardly by the feeding roller 61 and printed at a printing position in the middle of the front wall portion 34A by the ink jet head 7. A printed portion of the tape T is sent along a feeding path between the front wall portion 34A and the upper guide wall 35, and discharged from the tape discharge port 101B open to the rear of the body case by a pair of guide plates 54, 55 extending obliquely rearward from the upper edge of the feeding path and a discharge roller 56.

Figure 7:
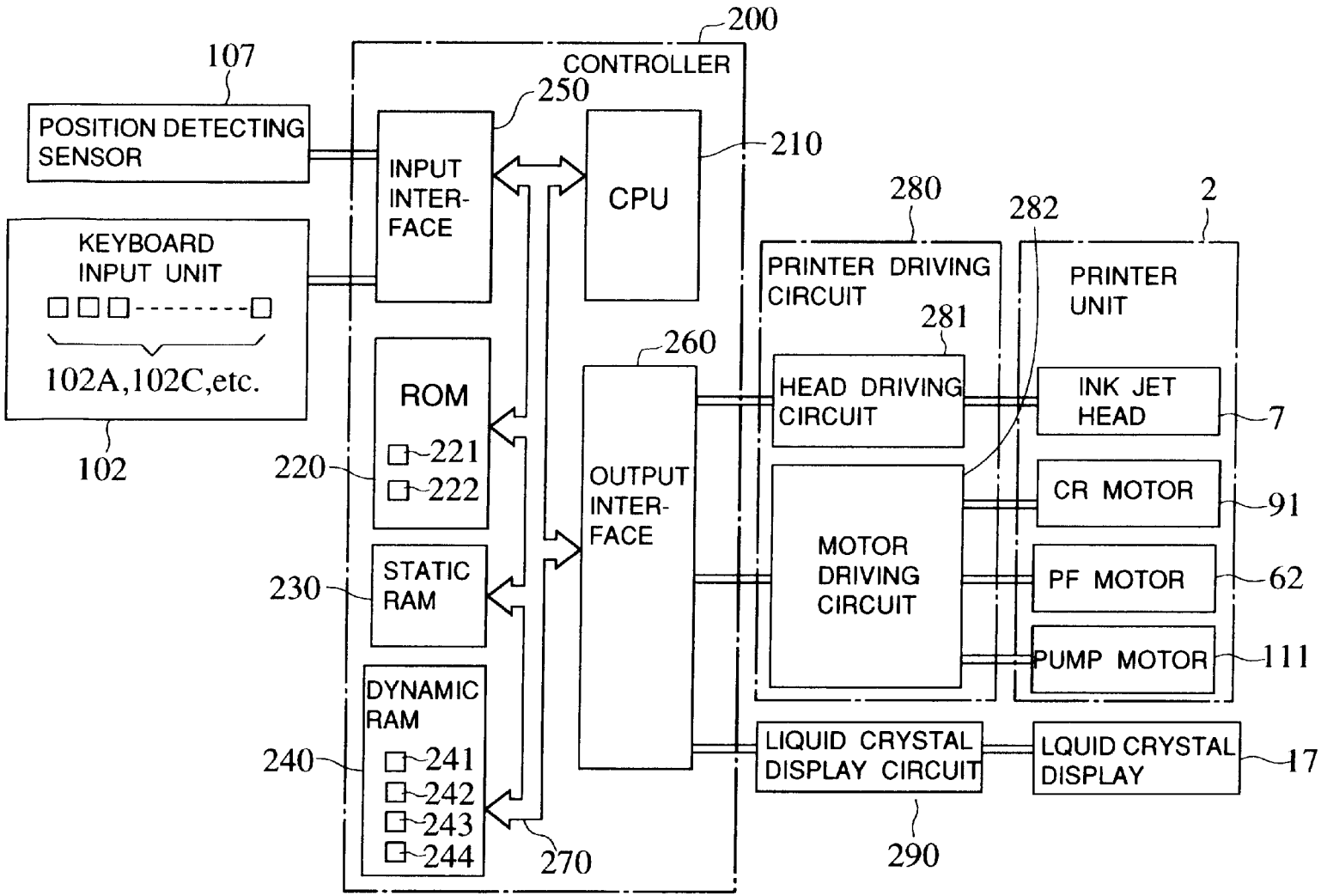
FIG. 7 is a block diagram illustrating the configuration of a control system in the ink jet printer of FIG. 3.

Next, a basic configuration of a control system in the ink jet printer 1 will be described with reference to FIG. 7. The control system basically comprises a controller 200, the keyboard input unit 102, the position detecting sensors 107, a printer driving circuit 280 and a liquid crystal display driving circuit 290.

As mentioned previously, the keyboard input unit 102 is used to feed the controller 200 with not only printing data such as characters, symbols and so on but also color specifying data as a printing color, in which such printing data is printed, through key manipulations on the color specifying keys 102C and the color setting key 102A on the keyboard input unit 102. The position detecting sensors 107, as mentioned previously, detect when the ink jet head 7 reaches the home position (not shown) at the left (right) end of the print available range, and inputs a signal indicative of the detection to the control unit 200. The printer driving circuit 280 comprises a head driving circuit 281 for driving the ink head 7 of the printer unit 2, and a motor driving circuit 282 for driving the CR motor 91, the PF motor 62 and the pump motor 111, and controls an associated portion in the printer unit 2 based on a control signal output thereto from the control unit 200 and in accordance with an instruction given thereto through the control signal. Similarly, the liquid crystal display driving circuit 290 controls the liquid crystal display unit 17 in accordance with instructions from the control unit 200.

The control unit 200 comprises a CPU 210, a ROM (Read Only Memory) 220, a static RAM (Random Access Memory) 230, a dynamic RAM 240, an input interface 250, and an output interface 260, all of which are interconnected through an internal bus 270.

The ROM 220 stores a color conversion table 221, a character decoration table 222 and so on other than control programs or the like which are executed by the CPU 210. The static RAM 230 is used as a work area for control processing, for example, for storing data input from the keyboard input unit 102 as text data. The static RAM 230 is supplied with electric power by a backup circuit (not shown) so as to hold stored data even if the aforementioned power supply button 104 is switched to turn off the electric power to the ink jet printer 1. The dynamic RAM 240 serves as a buffer for temporarily storing results input from the keyboard input unit 102 as printing data and display data, and includes a display buffer 214, a color conversion buffer 242, a dot expansion buffer 243, as well as a variety of conversion buffers 244, and so on.

The input interface 250 is connected to the keyboard input unit 102 and the position detecting sensors 107 to fetch input data from the keyboard input unit 102 and position detecting signals from the position detecting sensors 107 into the internal bus 270. The output interface 260, in turn, outputs data and control signals delivered from the CPU 210 and so on to the internal bus 270 to the printer driving circuit 280 and the liquid crystal display driving circuit 290.

With the configuration described above, the CPU 210 processes character printing data, color specifying data and so on input from the keyboard input unit 102 through the input interface 250; the position detecting signals from the position detecting sensor 107; and data stored in the static RAM 230 and the dynamic RAM 240 in accordance with the control program stored in the ROM 220, and generally controls the entire ink jet printer 1 by outputting control signals to the printer driving circuit 280 and the liquid crystal display driving circuit 290 through the output interface 260 to control the liquid crystal display unit 17, to control the PF motor 62 and the CR motor 91 for zero point correction, printing position control and so on, and to control the ink jet head 7 to print a color image on the tape T under a predetermined printing condition.

Next, the printing control processing, which features the present invention, will be described with reference to FIG. 8. Upon starting the processing by powering on the ink jet printer 1, or by any other associated manipulation, initial settings are first performed (S1). Subsequently, when text data or the like, which is the base of image data, is input through the keyboard input unit 102, image data composed of a dot matrix is created (S2). This image data serves as original data for a print image to be printed on the tape T. When the print button 103 is depressed after confirming through the liquid crystal display unit 17 that data input and so on have all been completed, the completion of the creation of the image data and the start of the printing are detected (S3: Yes), and then a determination is made as to whether or not the printing is performed in the right direction (S4).

Figure 1A:
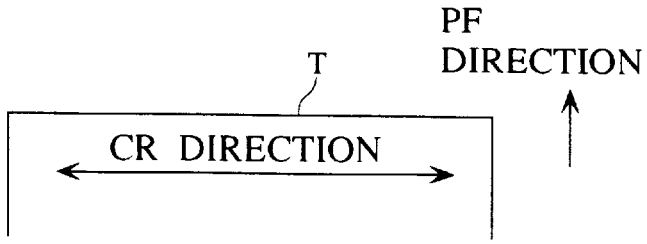
FIG. 1A PRIOR ART
FIGS. 1A–1D show how uni-directional printing and bi-directional printing are performed.
Figure 1B:
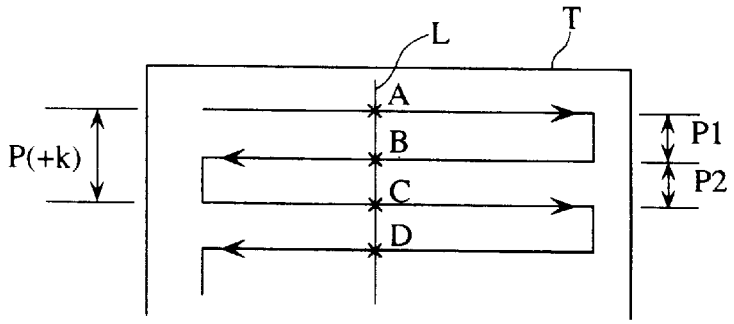

In the determination of the printing direction (S4), if the printing is performed with the ink jet head 7 moved from left to right, as previously mentioned in connection with FIG. 1B, i.e., in the right direction (S4: Yes), a P1 control (S5) is next performed. Conversely, if the printing is performed with the ink jet head 7 moved in the reverse direction, i.e., in the left direction (S4: No), a P2 control (S6) is next performed. The contents of the P1 control (S5) and the P2 control (S6) will be described later.

When the P1 control (S5) or the P2 control (S6) is completed, it is determined whether or not the printing is completed (S7) by checking whether all dot data constituting the image data has been printed, or whether an instruction is input to stop the printing through a forced termination key, or the like. If the printing has not been completed (S7: No), the printing is continued by the above-mentioned loop processing from the determination (S4) as to whether the printing is performed in the right direction to the determination (S7) as to whether the printing is completed. When the printing is completed (S7: Yes), the processing again proceeds to step S2 where text data or the like is input through the keyboard input unit 102 and image data is created. Subsequently, processing similar to the foregoing is performed.

Next, the principles of a uni-directional printing control and a bi-directional printing control will be summarized prior to describing the contents of the P1 control (S5) and the P2 control (S6).

Figure 1C:
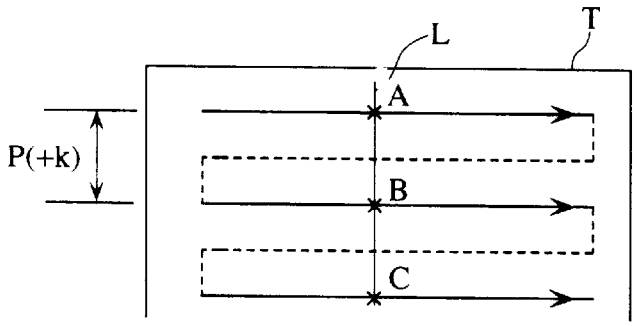

As illustrated in FIG. 1C, a feeding pitch of the tape T in the uni-directional printing control, i.e., a displacement between adjacent dots printed with the same nozzle in a tape feeding direction (hereinafter referred to as the "PF direction" as illustrated in FIG. 1A) is designated by a feeding pitch P, and a pitch of nozzles of the ink jet head in the PF direction is designated by a nozzle pitch D. The feeding pitch P and the nozzle pitch D are both expressed in dots. More specifically, in the right-direction printing of FIG. 1C, when the feeding pitch P is equal to one (P=1), a dot printed with a nozzle at a point A in the first operation is displaced from a dot printed with the same nozzle at a point B in the second operation by one dot in the PF direction. Thus, they are adjacent dots.

For example, as illustrated in a pattern [A] of FIG. 10A, with the feeding pitch P equal to one (P=1), after one dot is printed (Pass=1, Step=0 in FIG. 10A) at an arbitrary point in the PF direction (in FIG. 10A, deviation from a reference position t=0 in the PF direction is expressed by the number of dots along the downwardly extending axis labelled "Step") with an arbitrary nozzle ① in the first printing (the number of printing is indicated by a numeral n along the right axis labelled "Pass" in FIG. 10A), a dot can be immediately printed at a position one dot below in the second printing (Pass=2, Step=1 in FIG. 10A. The position in the CR direction is the same as in the first printing). In other words, a dot can be printed at a position immediately adjacent to the first dot in the PF direction with the same nozzle ①.

Next, when the feeding pitch P is equal to two (P=2), since a dot printed with the nozzle ① in the first printing (Pass=1, Step=0) is displaced from a dot printed with the same nozzle ① in the second printing (Pass=2, Step=2) by two dots in the PF direction, adjacent dots (Step=1) could not be printed with the single nozzle ①, as illustrated in a pattern [B] of FIG. 10B. In this event, if the nozzle pitch D is equal to one (D=1), a dot can be printed with a next nozzle ② (the lower adjacent nozzle) at the position at which the nozzle ① is unable to print in the first printing (Pass=1, Step=1).

While all dots can be printed with the nozzle ① irrespective of the nozzle pitch D in the pattern [A] of FIG. 10A, the nozzle ② is required in the pattern [B] of FIG. 10B. With the feeding pitch P equal to two (P=2) and the nozzle pitch D equal to two (D=2), all dots cannot be printed. Note that hatched portions in respective patterns of FIGS. 10A–10D each indicate a position at which a dot can be printed with a next nozzle (for example, a nozzle ③ in the pattern [B] of FIG. 10B), if used, but at which the next nozzle is not required for the printing.

As described above, whether or not all dots can be printed depends on the feeding pitch P for the tape T and the nozzle pitch D for the ink jet head 7. Then, the position of a printable dot R (expressed by the number of the above-mentioned Steps) can be represented using the pitches P and D as parameters by:

$$R=(P+k)j+Di \tag{1}$$

where j is a variable indicative of the number of printing (j=n−1 (j=0, 1, 2, . . . ) in $n^{th}$ printing), i is a variable indicative of the position of a nozzle when the nozzle pitch is D (an $n^{th}$ nozzle is expressed by i=n−1 (i=0, 1, 2, . . . ), and k is a correction value used in actual printing when the feeding pitch P does not match well with any integer multiple of the number of dots or when the feeding pitch P does not meet conditions for printing all dots, later described. Assuming that a pitch including this correction value k is P, the foregoing equation (1) is rewritten as:

$$R=Pj+Di \quad (2)$$

Next, the equation (1) or (2) will be described in greater detail with reference to FIGS. 9–12. For example, a printable dot R is represented by j+i when the feeding pitch P (+k) is equal to one and the nozzle pitch D is equal to one (a column "No. 1-1" in FIG. 9. Other columns are also indicated by "No. P-D"). Thus, as illustrated in FIG. 9, the value of a printable dot R is 0, 1, 2, . . . (R=0, 1, 2, . . . ) for i=0, 1, 2, . . . when j=0, and R is 1, 2, 3, . . . (R=1, 2, 3, . . . ) for i=0, 1, 2, . . . when j=1. In this case, the position of any dot (Step=0, 1, 2, . . . ) can be represented only with i=0 (only by changing j), so that all dots can be printed only with i=0, i.e., with an $(i+1)^{th}$ nozzle (the aforementioned nozzle ①).

The same is applied also when the feeding pitch P is equal to one (P=1) and the nozzle pitch D is equal to two (D=2), as shown in a column "No. 1-2." Since all dot positions, i.e., printable dots R=0, 1, 2, . . . can be represented only with i=0 irrespective of the existence of each nozzle i≧1, all dots can be printed by the single nozzle i=0. The feeding pitch P equal to one (P=1) corresponds to the pattern [A] of FIG. 10A which represents that all dots can be printed with the single nozzle ① irrespective of the nozzle pitch D.

Next, a combination of the feeding pitch P equal to two (P=2) and the nozzle pitch D equal to one (D=1) (a column "No. 2-1") in FIG. 9 corresponds to the aforementioned pattern [B] of FIG. 10B. Specifically, since printable dots R are 0, 2, 4, . . . (R=0, 2, 4, . . . ) only with the nozzle i=0 (the nozzle ① in FIG. 10B) for j=0, 1, 2, . . . , every other dots can only be printed. However, since the nozzle i=1 (the nozzle ②) provides printable dots R equal to 1, 3, 5, . . . (R=1, 3, 5, . . . ), all dots can be printed if two nozzles with the nozzle pitch D equal to one (D=1) are available (the nozzles ① and ②).

A combination of the feeding pitch P equal to two (P=2) and the nozzle pitch D equal to two (D=2) in FIG. 9 only provides printable dots R expressed by 2j+2i (R=2j+2i), so that dots can be printed at positions of integer multiples of two, i.e., at even-numbered positions and no dots can be printed at odd-numbered positions.

With a combination of the feeding pitch P equal to two (P=2) and the nozzle pitch D equal to three (D=3), two nozzles i=0, 1 may be used to provide printable dots R equal to 0, 2, 3, 4, 5, . . . (R=0, 2, 3, 4, 5, . . . ), so that all dots except for Step=1 can be printed. This case corresponds to the pattern [C] illustrated in FIG. 10C, where all dots subsequent to Step=2 can be printed, so that, for example, the ink jet head 7 is moved such that the nozzle ② is placed to print at the position Step=3 in the first printing (Pass=1) to permit only the nozzle ② to print a dot at that position, and then the nozzles ① and ② are permit to print dots from the second printing (Pass=2), thereby making it possible to print all dots.

As described above, when all printable dots R appear from a certain value, the ink jet head 7 may be controlled such that an initial position of the ink jet head 7 is changed, and a portion of nozzles are only used in the first and subsequent several printing sequences, thereby making it possible to print all dots. In the following description, such a case is expressed as "the printing is OK after Step=n" (for example, the printing is OK after Step=2 in the above described example).

In the aforementioned case with the combination of the feeding pitch P equal to two (P=2) and the nozzle pitch D equal to two (D=2) in FIG. 9, the correction value k in equation (1) may be used to define, for example, the feeding pitch P+k equal to three (P+k=3) when the correction value k is set at one (k=1). In this way, the printable dot R is expressed by R=3j+2i which represents a pattern in FIG. 11, later described, (a column "No. 3-2" in FIG. 11), and in which case the printing is OK after Step=2 by using three nozzles ①, ②, ③.

Similarly, with a combination of the feeding pitch P equal to two (P=2) and the nozzle pitch D equal to five (D=5) in FIG. 9, all of printable dots R equal to and larger than four (R≧4) appear if two nozzles i=0, 1 are used, so that the printing is OK after Step=4, as illustrated in the pattern [D] of FIG. 10D. Also similarly, the printing is OK after Step=6 in a combination of the feeding pitch P equal to two (P=2) and the nozzle pitch D equal to seven (D=7) in FIG. 9.

FIG. 11 is a diagram similar to FIG. 9 except that the feeding pitch P is equal to three (P=3), wherein the printing is OK after Step=0, 2, 6, 8, . . . , by using three nozzles i=0, 1, 2, with the nozzle pitch D set at one, two, four, five, . . . (D=1, 2, 4, 5, . . . ) except for the nozzle pitches D equal to three, six, . . . (D=3, 6, . . . ) with which resulting printable dots R are all integer multiples of three. The printable dots R shown in FIG. 11 may provide patterns [E], [F], [G], [H] as illustrated in FIGS. 12A, 12B, 12C, 12D, respectively, when they are printed.

Next, an example of a printing control, regarded as a modification to the printing control described in connection with the foregoing FIGS. 10–12, will be described with reference to FIGS. 13–17.

FIG. 13 shows the values of printable dots R when the feeding pitch P is equal to four (P=4) and the nozzle pitch D is equal to three (D=3). In this case, when four nozzles ①, ②, ③, ④ (i=0, 1, 2, 3) are used as shown in FIG. 14A, the printing is OK after Step=6, and the dots R can be printed in a pattern [J] illustrated in FIG. 15. This is a similar printing control to that described previously in connection with FIGS. 10–12. In addition to this, modified printing controls may also be provided as shown in FIGS. 14B and 14C.

Specifically, when four nozzles ①, ②, ③, ④ (i=0, 3, 6, 9) in FIG. 13 are used, the printing is OK after Step=24, as shown in FIG. 14B, and the dots can be printed in a pattern [K] illustrated in FIG. 16. This is equivalent to the case where the nozzle pitch D is increased by a factor of three, i.e., the printable dot R is defined as R=4j+9i and four nozzles ①, ②, ③, ④ (i=0, 1, 2, 3) are used. By creating a table or the like which totally lists printable dots R as shown in FIG. 13, the possibility of other printing controls can be analyzed utilizing the same table.

Similarly, FIG. 14C shows a printing control when four nozzles i=0, 2, 3, 5 in FIG. 13 are selected, wherein the printing is OK after Step=12, and the dots can be printed in a pattern [L] illustrated in FIG. 17. More specifically, a printing control can be accomplished to print all dots utilizing a table created as shown in FIG. 13, i.e., utilizing the printable dots R calculated on the basis of equation (1) or (2), even if a nozzle pitch between respective adjacent ones of used nozzles is irregular.

As described above with reference to FIGS. 13–17, while a variety of printing controls are possible by changing the selection of nozzles based on the values of the printable dots R, the following description will be made only on the selection of the most typical nozzles, i.e., the case corresponding to FIG. 14A, for facilitating the understanding.

When the printing control shown in FIG. 14A is utilized for bi-directional control as shown in FIG. 1B, the pattern [J] of FIG. 15 may be illustrated as a pattern [N] of FIG. 19B.

In the pattern [N] of FIG. 19B, Pass=1-0 corresponds to the right-direction printing in FIG. 1B, while Pass=1-1 corresponds to the left-direction printing in FIG. 1B.

For example, a dot can be printed at a point A in FIG. 1B (at Pass=1-0, Step=0 in the pattern [N]) with a nozzle ① while moving the ink jet head 7 in the first right-direction printing, and a dot can be printed at a point B in FIG. 1B (at Pass=1-1, Step=4) in the first left-direction printing. Similarly, a dot can be printed at a point C (at Pass=2-0, Step=8) in the second right-direction printing and a dot can be printed at a point D (at Pass=2-1, Step=12) in the second left-direction printing.

In this event, assuming that the feeding pitch P is P1 when the ink jet head 7 is positioned at the right limit and P2 when it is positioned at the left limit, the feeding pitch P1 is equal to the feeding pitch P2, and their values are four (P1=P2=4). Also, the printable dots R when j=0, 2, 4, . . . in FIG. 14A can be printed in the right-direction printing, while the printable dots R when j=1, 3, 5, . . . in FIG. 14A can be printed in the left-direction printing.

In addition, the printing control may also be modified by changing any factor other than the selection of nozzles based on the values of the printable dots R in FIG. 13. Specifically, FIG. 18 shows a printing control utilizing the printable dots R of j=0, 2, 4, . . . in FIG. 13. In this event, the printing is OK after Step=14 when using eight nozzles ①–⑧ of i=0-7 in FIG. 13, and dots can be printed in a pattern [M] of FIG. 19A. This is equivalent to the case where the feeding pitch P is increased by a factor of two, i.e., the printable dot R is defined as R=8j+3i and eight nozzles ①–⑧ of i=0-7 are used.

Then, the present invention may be implemented utilizing the printing controls represented by the patterns [M] and [N] of FIGS. 19A and 19B based on the printable dots R in FIG. 14A and FIG. 18.

Next, the P1 control (S5 in FIG. 6) and the P2 control (S6 in FIG. 6) in the printing control processing, featuring the present invention, will be described with reference to FIGS. 8, 14A, 18 and 19. It is assumed in this embodiment that black has a stronger contrast to a color of a tape T than other colors, i.e., three primary colors of yellow, cyan, magenta, for example, as is the case of a white tape T. For this reason, a uni-directional printing control as illustrated in the patterns of FIG. 18 and FIG. 19A is performed for black (in FIG. 8, "Black: Uni-d control" is noted in S5), while a bi-directional control as illustrated in the patterns of FIG. 14A and FIG. 19B is performed for other colors (in FIG. 8, "Other Colors: Bi-d-P1 Control" is noted in S5 as a control for right-direction printing, and "Other Colors" Bi-d-P2 Control" is noted in S6 as a control for left-direction printing).

Referring again to FIG. 8, upon starting the printing (S3: Yes), it is next determined whether or not right-direction printing is performed (S4). In this embodiment, since right-direction printing is first performed (S4: Yes), the P1 control (S5) is next executed.

Here, as illustrated in FIG. 19A, dots are printed on a print image using nozzles ⑥–⑧ within eight nozzles ①–⑧ for printing black dots in accordance with dot information on image data (see Pass=1, Step=15, 18, 21 in the pattern [M] of FIG. 19A and j=0, i=5–7 in FIG. 18). In this event, since no dots are printed in other colors after Step=14 in Pass=1-0 as illustrated in the pattern [N] of FIG. 19B, the printing control therefor is not performed (S5 in FIG. 8).

Figure 8:
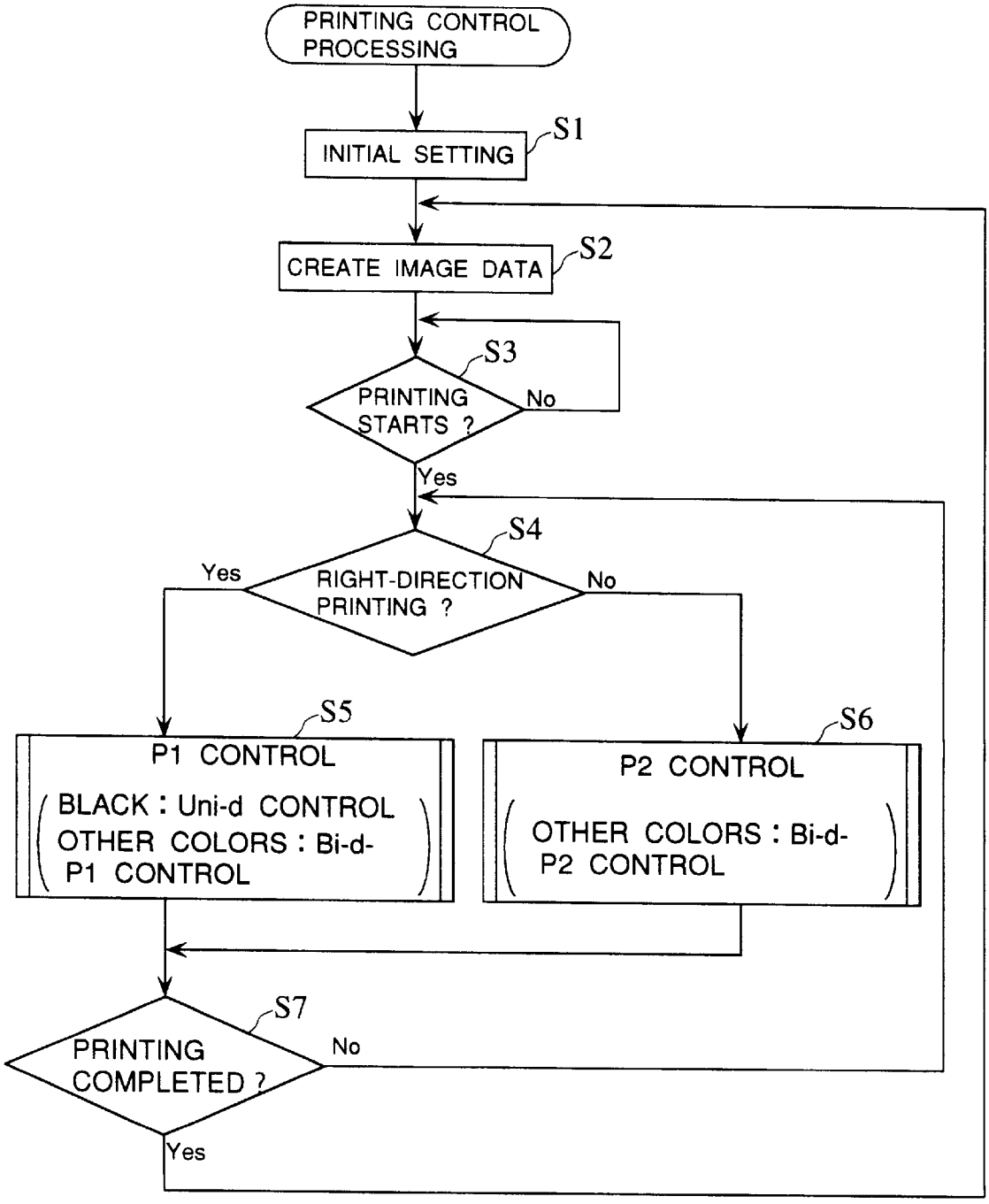
FIG. 8 is a flow chart illustrating the printing control processing in the ink jet printer of FIG. 3.

As illustrated in FIG. 8, when the P1 control (S5) is terminated, it is next determined whether or not the printing is completed (S7). When the printing has not been completed (S7:No), it is next determined whether or not right-direction printing is performed (S4). Since left-direction printing is next performed (S4: No), the P2 control (S6) is executed.

In this event, since the uni-directional printing control is performed for black, no black dots are printed in the left-direction printing. Also, since no dots are printed in the other three colors after Step=14 in Pass=1-1 as illustrated in the pattern [N] of FIG. 19B, the printing control therefor is not performed (S6 in FIG. 8). Of course, such processes can be predictable from control information, so that the processing may immediately proceed to a control for Pass=2, later described, omitting the control for Pass=1-1. However, all associated controls will be herein described in order for convenience of explanation.

Referring further to FIG. 8, after the P2 control (S6) is terminated, it is next determined whether or not the printing is completed (S7). When the printing has not been completed (S7: No), the P1 control (S5) is performed since next performed is the right-direction printing (S4: Yes).

In this event, as illustrated in FIG. 19, black dots are printed on a print image using nozzles ③–⑧ within the eight nozzles ①–⑧ for printing black dots in accordance with the uni-directional printing control (see Pass=2, Step=14, 17, 20, 23, 26, 29 in the pattern [M] and j=2, i=2–7 in FIG. 18), while dots in the other colors are printed using nozzles ③ and ④ within four nozzles ①–④ for the respective colors in accordance with the bi-directional printing control (see Pass=2-0, Step=14, 17 in the pattern [N] and j=2, i=2, 3 in FIG. 14A) (S5 in FIG. 8).

When the P1 control (S5) is terminated, it is next determined whether or not the printing is completed (S7). When the printing has not been completed (S7: No), the P2 control (S6) is performed since next performed is the left-direction printing (S4: No).

In this event, since the uni-directional printing control is performed for black, no black dots are printed in the left-direction printing. Dots in the other colors, in turn, are printed using nozzles ②–④ within four nozzles ①–④ for the respective colors in accordance with the bi-directional printing control as illustrated in the pattern [N] of FIG. 19B (see Pass=2-1, Step=15, 18, 21 in the pattern [N] and j=3, i=1–3 in FIG. 14A) (S6 in FIG. 8).

When the P2 control (S6) is terminated, it is next determined whether or not the printing is completed (S7). When the printing has not been completed (S7: No), the P1 control (S5) is performed since next performed is the right-direction printing (S4: Yes). Here, black dots are printed using the eight nozzles ①–⑧ for printing black dots in accordance with the uni-directional printing control (see Pass=3, Step=16, 19, 22, 25, 28, 31, 34, 37 in the pattern [N] and j=4, i=0–7 in FIG. 18), while dots in the other colors are printed using nozzles ①–④ for the respective colors (see Pass=3-0, Step=16, 19, 22, 25 in FIG. 19N and j=4, i=0–3 in FIG. 14A) (S5 in FIG. 8).

When the P1 control (S5) is terminated, it is next determined whether or not the printing is completed (S7). When the printing has not been completed (S7: No), the P2 control (S6) is performed since next performed is the left-direction printing (S4: No). Here, no black dots are printed, while dots in the other colors are printed using the respective four nozzles ①–④ (see Pass=3-1, Step=20, 23, 26, 29 in the pattern [N] and j=5, i=1–3 in FIG. 14A) (S6 in FIG. 8).

When the P2 control (S6) is terminated, it is next determined whether or not the printing is completed (S7). When the printing has not been completed (S7: No), the printing is continued by executing the steps in a loop from the determination as to whether or not the right-direction printing is performed (S4) to the determination as to whether or not the printing is completed (S7). When the printing is completed (S7: Yes), the processing again proceeds to step S2 for inputting text data or the like through the keyboard input unit 102 and creating image data, followed by the execution of similar processing as the foregoing.

Figure 1D:
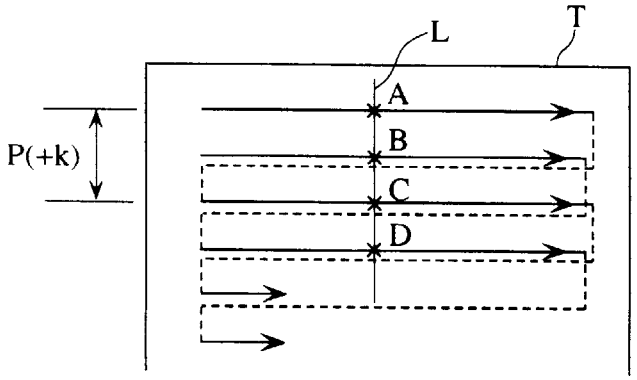
Figure 2:
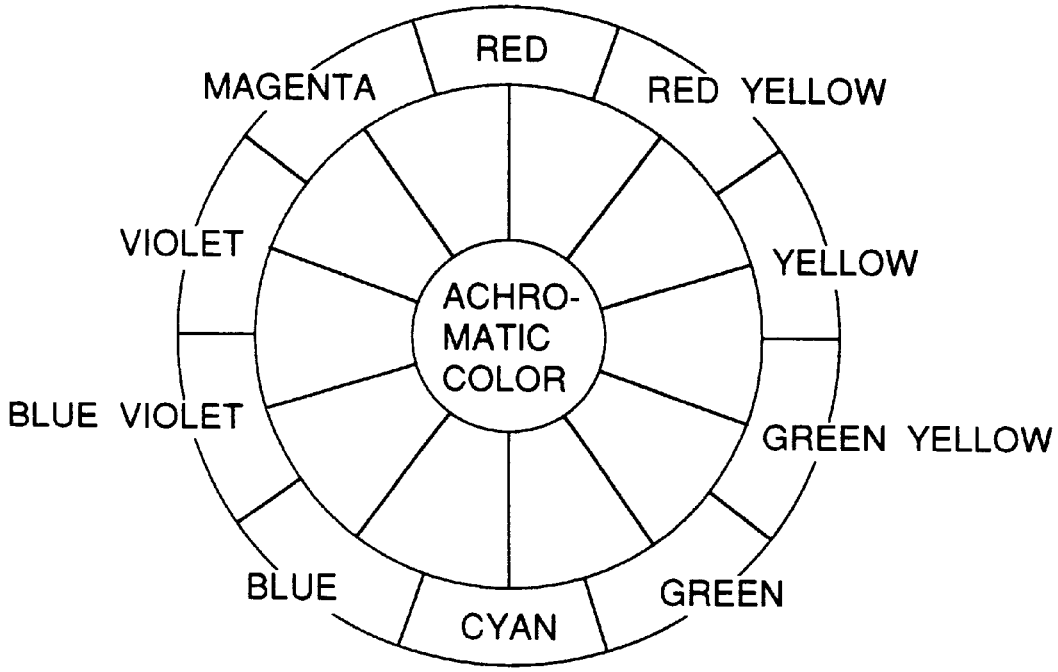
FIG. 2 shows a hue ring for reference.

As described above, since the ink jet printer (color printing apparatus) 1 of this embodiment prints a color (for example, black) having a high contrast to the color of a tape (printing medium) T (white is supposed in the foregoing description) in one of the two directions orthogonal to the feeding direction of the tape T, moving conditions for the ink jet head (printing means) in a printing operation can be made identical for all dots to be printed. Stated another way, since positional deviation due to a difference in moving direction or the like in the bi-directional printing can be prevented, horizontal deviations are less likely to occur even when a straight line or the like is drawn (see FIG. 1D).

Also, since the printing in other colors (yellow, cyan, magenta) is controlled by the bi-directional printing similar to the prior art (see FIG. 1B), it is possible to meet requirements to printing speed, printing quality, and so on. In addition, since these colors have a relatively low contrast, deviations are less prominent even if occurring in an image. It can therefore be appreciated that the ink jet printer 1 of this embodiment provides for highly attractive print images and high speed printing with a relatively simple position control similar to that used in a uni-directional printing scheme without requiring a highly accurate position control. In other words, even if a total position control is performed only based on the left limit in a manner similar to the uni-directional printing control, deviations in the horizontal direction or the like are not apparent, so that attractive color printing can be provided.

As is also apparent from the patterns of FIGS. 19A and 19B in the foregoing embodiment, since the number of dots (eight dots in the pattern [M] of FIG. 19A) printable by the uni-directional printing in one reciprocal movement of the ink jet head 7 is equal to or larger than the number of dots (4 dots×2=8 dots in the pattern [N] of FIG. 19B) printable by the bi-directional printing, even the uni-directional printing can maintain the printing speed, the printing quality and so on comparable to those provided by the bi-directional printing and can accomplish highly attractive color printing with a relatively simple position control similar to that used in a uni-directional printing scheme.

In addition, since the foregoing ink jet printer 1 (color printing apparatus) employs a tape-like printing medium, the ink jet printer 1 may be applied, for example, to a color printer for printing on a tape for creating labels or the like. Particularly when an image or the like is printed on a tape T, it is often the case that respective character strings aligned in the longitudinal direction (feeding direction or PF direction) are printed in a plurality of rows in the width direction (reciprocally moving directions orthogonal to the feeding direction or CR direction). In such a situation, since positional deviations or the like in the horizontal direction appear as distorted character strings, the deviations become more prominent. Thus, the above-mentioned advantage of making less prominent the positional deviations in the horizontal direction (width direction) acts more effectively in the situation mentioned above.

It should be noted that while in the foregoing embodiment, the feeding pitch P1 is set equal to the feeding pitch P2 in the bi-directional printing control, and the feeding pitch P for the uni-directional printing control is chosen to be 2P1 (P1+P2=2×P1), the feeding pitch P1 may be different from the feeding pitch P2.

FIGS. 20A and 20B illustrate exemplary patterns of the values of printable dots R when the feeding pitch P is equal to five (P=5) and the nozzle pitch D is equal to four (D=4) in a uni-directional printing control. Unlike the aforementioned tables of the printable dots R, these tables also include the values of printable dots R for the left-direction printing control, i.e., the P2 control in the bi-directional printing control.

In these examples, a column "j-0 (j=0, 1, 2, 3, . . . )" in each of FIGS. 20A and 20B show printable dots R by the P1 control in FIG. 8 (S5: "Black: Uni-d Control" and "Other Colors: Bi-d-P1 Control"); a column "j-2 (j=0, 1, 2, 3, . . . )" in FIG. 20A shows printable dots R by the P2 control when the feeding pitch P1 is equal to two (P1=2) (S6: "Other Colors: Bi-d-P2 Control"); and a column "j-3 (j=0, 1, 2, 3, . . . )" in FIG. 20B shows printable dots R by the P2 control (S6) when the feeding pitch P1 is equal to three (P1=3).

Based on the printable dots R in FIGS. 20A and 20B, for example, based on the printable dots R in the column j-0, and using five nozzles ①–⑤ of i=0–4, the printing is OK after Step=12, and the printing can be performed in accordance with a uni-directional printing control (Black: Uni-d Control) as illustrated in a pattern [O] of FIG. 21A or FIG. 22A.

Alternatively, based on the printable dots R in the column j-0 and the column j-2 in FIG. 20A and using three nozzles of i=0–2, by way of example, the printing is OK after Step=4. In this case, since printable dots R corresponding to i=2 when the P2 control (the column j-2) is selected are identical to printable dots R corresponding to i=0 when the P1 control (the column j-0) is selected, the nozzle ③ of i=2 is not required in the P2 control. A pattern [P] of FIG. 21B represents the bi-directional printing control of FIG. 20A by using a circle "○" for enclosing dots printed with nozzles in accordance with the P1 control (Other Colors: Bi-d-P1 Control), similarly to the respective patterns mentioned previously, and by using a square "□" for enclosing dots printed with nozzles in accordance with the P2 control (Other Colors: Bi-d-P2 Control) in place of "○." It can be understood also from the pattern [P] that the printing is OK after Step=4.

Similarly, based on the printable dots R in the column j-0 and the column j-3 in FIG. 20B and using three nozzles of i=0–2, the printing is OK after Step=7. In this case, since the printable dots R corresponding to i=0 when the P2 control (the column j-3) is selected are identical to the printable dots R corresponding to i=2 when the P1 control (the column j-0) is selected, the nozzle ① of i=0 is not required in the P2 control. Consequently, the printing can be performed in accordance with a bi-directional control as illustrated in the pattern [Q] of FIG. 22B.

A combination of the uni-directional printing control illustrated by the pattern [O] of FIG. 21A and the bi-directional printing control illustrated by the pattern [P] of FIG. 21B, and a combination of the uni-directional printing control illustrated by the pattern [O] of FIG. 22A and the bi-directional printing control illustrated by the pattern [Q] of FIG. 22B may be applied to the P1 control (S5) and the P2 control (S6) in FIG. 8, similarly to a combination of the uni-directional printing control illustrated by the pattern [M] of FIG. 19A and the bi-directional printing control illustrated by the pattern [N] of FIG. 19B. Since the printing control using such combinations is apparent from the description of the respective patterns and the printing controls applying the patterns of the aforementioned FIGS. 19A and 19B, explanation thereon is omitted.

Since a high contrast color (for example, black) is printed by the uni-directional printing control likewise in the above-mentioned case, horizontal positional deviations are less likely to occur even when a straight line or the like is drawn. Also, since the other colors are printed by the bi-directional printing control, it is possible to meet the requirements to the printing speed, the printing quality, and so on. In addition, since these colors have a relatively low contrast, deviations are less prominent even if occurring in an image.

As is also apparent from the patterns of FIGS. 21 and 22 similar to the aforementioned FIGS. 19A and 19B, since the number of dots (five dots in the patterns [O] of FIGS. 21A and 22A) printable by the uni-directional printing in one reciprocal movement of the ink jet head 7 is equal to or larger than the number of dots (3+2=5 dots in the pattern [P] of FIG. 21B and in the pattern [Q] of FIG. 22B) printable by the bi-directional printing, even the uni-directional printing can maintain the printing speed, the printing quality and so on comparable to those provided by the bi-directional printing and can accomplish highly attractive color printing with a relatively simple position control.

It should be noted that the ink jet printer 1 of the foregoing embodiment may employ any other printing control by creating a variety of tables or the like for totally listing printable dots R as described earlier in connection with FIG. 14, utilizing the same tables to change the selection of nozzles, and changing the nozzle pitch D for the ink jet head 7 and the feeding pitch P for the tape T. Moreover, since highly attractive print images can be provided as long as an accurate position detection is carried out only from one side, one of the left and right position detecting sensors 107 may be omitted to reduce the price by employing a simpler position control.

As has been described in connection with the object of the present invention, when a character image (or a sequence of character images) such as a letter, a symbol, a figure, or the like is printed on a predetermined background image, while the background image may be rough to some degree as long as a general appearance is understandable, a character image must be clearly identifiable, so that deviations of dots printed as a character image are more prominent. The present invention can be applied likewise in such a case.

More specifically, a character image, in which deviations of printed dots are more prominent, may be printed in one of the two directions to prevent the dots from deviating due to a difference in moving direction or the like in the bi-directional printing. On the other hand, the background image, which may be relatively roughly printed, may be provided under the bi-directional printing control similar to the prior art, thereby making it possible to meet the requirements to the printing speed, the printing quality, and so on. It will therefore be appreciated that the present invention can provide, even in such a situation, high speed color printing and attractive print images with a relatively simple position control similar to that used in a uni-directional printing scheme.

It is often the case that a high contrast color is employed for a character image with respect to a background image in order to clearly print the character image. In such a case, the above-mentioned advantage of the present invention acts more effectively. More specifically, since a character image is printed in a high contrast color relative to a background image, the character image can be clearly and distinctively printed with respect to the background image. In addition, since the character image is printed under the uni-directional printing control, deviated dots due to a difference in moving direction or the like in the bi-directional printing can be prevented in the character image.

Moreover, the aforementioned embodiment also has similar advantages to the above. More specifically, when a print image has a character image and a background image, the character image may be printed using a high contrast color relative to the color of a tape T (background color) under the uni-directional printing control, while the background image may be printed using another color under the bi-directional printing control. In this way, the character image can be clearly and distinctively printed, and likewise, the uni-directional control eliminates deviated dots due to a difference in moving direction or the like in the bi-directional printing.

While in the foregoing embodiment, the present invention has been applied to an ink jet printer for printing on a tape T fed from a tape cartridge, the present invention may be applied similarly to other types of ink jet printers. For example, the printing medium may be ordinary printing paper, sheets of paper of the post card size or the like, and so on. The present invention is also applicable to any ink jet printer as long as it is capable of printing in two or more colors instead of full four colors of cyan, magenta, yellow and black. In addition, a high contrast color, to which the uni-directional printing control is applied, may be changed depending on the color of a printing medium.

Moreover, the present invention may be applied not only to the ink jet type printer but also to a sublimation type thermal transfer printer which sublimes ink by a heating element of a thermal head, a melting type thermal transfer printer, and so on. With a thermal transfer printer, similar effects can be produced when the principles of the present invention are applied to dot pins which function to print respective dots instead of the aforementioned respective nozzles.

As described above, the color printing apparatus according to the present invention effectively provides high speed color printing and highly attractive print images with a relatively simple position control.

While the present invention has been described above in connection with specific embodiments, it will be understood by those skilled in the art that various modifications can be made as required to the present invention without departing from the spirit and scope of the present invention as set forth in the appended claims.

What is claimed is:

1. A color printing apparatus comprising:

printing means for printing a color print image composed of a dot matrix on a printing medium;

feeding means for feeding said printing medium;

reciprocal moving means for reciprocally moving said printing means in directions orthogonal to a direction in which said printing medium is fed; and control means for instructing said printing means to perform printing in a plurality of colors to each dot of said color print image so as to selectively conduct uni-directional printing and/or bi-directional printing in said reciprocal movements of said printing means, said control means instructing said printing means to conduct said uni-directional printing for a high contrast color with respect to a background color of said printing medium within said plurality of colors, and instructing said printing means to conduct said bi-directional printing for the remaining colors;

said control means being capable of instructing said printing means to conduct a mixture of uni-directional printing and bi-directional printing in a given reciprocal movement of said printing means, the given reciprocal movement being in response to a print command and the uni-directional printing and bi-directional printing being mixed in accordance with data to be printed.

2. A color printing apparatus according to claim 1, wherein said print image includes a character image and a background image, and said control means instructs said printing means to print said character image using said high contrast color and to print said background image using one of said remaining colors.

3. A color printing apparatus according to claim 1 or 2, wherein said printing medium is a tape-like printing medium.

4. A color printing apparatus according to claim 1 or 2, further including means for selecting the number of printable dots during each reciprocal movement during uni-directional printing and bi-directional printing so that the number of printable dots provided by said uni-directional printing is equal to or larger than the number of printable dots provided by said bi-directional printing in each said reciprocal movement.

5. A color printing apparatus according to claim 4, wherein said printing medium is a tape-like printing medium.

6. A color printing apparatus comprising:

printing means for printing a color print image composed of a dot matrix on a printing medium;

feeding means for feeding said printing medium;

reciprocal moving means for reciprocally moving said printing means in a direction orthogonal to a direction in which said printing medium is fed; and control means for instructing said printing means to perform printing in a plurality of colors to each dot of said color print image so as to selectively conduct uni-directional printing and/or bi-directional printing in said reciprocal movements of said printing means, said color print image including a character image and a background image, said control means instructing said printing means to conduct said uni-directional printing for said character image and said bi-directional printing for said background image;

said control means being capable of instructing said printing means to conduct a mixture of uni-directional printing and bi-directional printing in a given reciprocal movement of said printing means, the given reciprocal movement being in response to a print command and the uni-directional printing and bi-directional printing being mixed in accordance with data to be printed.

7. A color printing apparatus according to claim 6, wherein said control means instructs said printing means to print said character image using said high contrast color with respect to said background image within said plurality of colors.

8. A color printing apparatus according to claim 6 or 7, wherein said printing medium is a tape-like printing medium.

9. A color printing apparatus according to claim 6 or 7, further including means for selecting the number of printable dots during each reciprocal movement during uni-directional printing and bi-directional printing so that the number of printable dots provided by said uni-directional printing is equal to or larger than the number of printable dots provided by said bi-directional printing in each said reciprocal movement.

10. A color printing apparatus according to claim 9, wherein said printing medium is a tape-like printing medium.

11. A color printing apparatus comprising:

printing means for printing a color print image composed of a dot matrix on a printing medium;

feeding means for feeding said printing medium;

reciprocal moving means for reciprocally moving said printing means in directions orthogonal to a direction in which said printing medium is fed; and control means for instructing said printing means to perform printing in a plurality of colors to each dot of said color print image so as to selectively conduct uni-directional printing and/or bi-directional printing in said reciprocal movements of said printing means, said control means instructing said printing means to conduct said uni-directional printing for a black color within said plurality of colors, and instructing said printing means to conduct said bi-directional printing for the remaining colors;

said control means being capable of instructing said printing means to conduct a mixture of uni-directional printing and bi-directional printing in a given reciprocal movement of said printing means, the given reciprocal movement being in response to a print command and the uni-directional printing and bi-directional printing being mixed in accordance with data to be printed.

* * * * *